US006145825A

United States Patent [19]

Kunihiro et al.

[11] Patent Number: 6,145,825

[45] Date of Patent: Nov. 14, 2000

[54] SHEET PROCESSING APPARATUS AND METHOD THEREFOR

[75] Inventors: Uotani Kunihiro, Seto; Masahiro Tamura, Yokohama; Yukitaka Nakazato; Kenji Yamada, both of Tokyo; Jun-ichi Iida, Yokohama; Akihito Andoh, Kawasaki; Yoshihiko Nakayama, Toyoake, all of Japan

[73] Assignee: Ricoh Company, Ltd., Tokyo, Japan

[21] Appl. No.: 09/094,482

[22] Filed: Jun. 10, 1998

[30] Foreign Application Priority Data

| | | | |
|---|---|---|---|
| Jun. 10, 1997 | [JP] | Japan | 9-152324 |
| Aug. 29, 1997 | [JP] | Japan | 9-234359 |
| May 22, 1998 | [JP] | Japan | 10-141593 |

[51] Int. Cl.[7] ..... B65H 33/04; B65H 29/44; A43B 21/36

[52] U.S. Cl. ..... 270/58.09; 270/58.27; 271/181; 271/221; 227/29

[58] Field of Search ..... 270/58.08, 58.09, 270/58.27; 271/181, 220, 221; 227/29, 83, 40

[56] References Cited

U.S. PATENT DOCUMENTS

| | | | |
|---|---|---|---|
| 5,013,021 | 5/1991 | Johdai et al. | 271/53 |
| 5,037,077 | 8/1991 | Kubota et al. . | |
| 5,056,774 | 10/1991 | Kubota et al. . | |
| 5,072,920 | 12/1991 | Kubota et al. . | |
| 5,083,760 | 1/1992 | Yamazaki et al. . | |
| 5,083,761 | 1/1992 | Johdai et al. | 271/3.1 |
| 5,094,660 | 3/1992 | Okazawa | 493/320 X |
| 5,121,911 | 6/1992 | Yamazaki et al. . | |
| 5,263,697 | 11/1993 | Yamazaki et al. . | |
| 5,320,336 | 6/1994 | Asami . | |
| 5,382,011 | 1/1995 | Tani | 270/37 |
| 5,478,062 | 12/1995 | Horiuchi et al. | 270/53 |
| 5,508,798 | 4/1996 | Yamada . | |
| 5,799,935 | 9/1998 | Yamanushi et al. | 270/58.08 |
| 5,826,158 | 10/1998 | Hirano et al. | 399/410 |
| 5,938,192 | 8/1999 | Kosasa | 271/221 |

FOREIGN PATENT DOCUMENTS

| | | | |
|---|---|---|---|
| 62-88597 | of 1987 | Japan . | |
| 1-88673 | of 1989 | Japan . | |
| 2-132064 | of 1990 | Japan . | |
| 0123072 | 5/1990 | Japan | 271/220 |
| 4-3773 | of 1992 | Japan . | |
| 6-55874 | of 1994 | Japan . | |

*Primary Examiner*—Christopher P. Ellis
*Assistant Examiner*—Kenneth W Bowes
*Attorney, Agent, or Firm*—Oblon, Spivak, McClelland, Maier & Neustadt, P.C.

[57] ABSTRACT

A sheet processing apparatus includes a staple tray that stacks a sheet discharged from an image forming apparatus, a rear end fence that vertically aligns the sheet stacked on the staple tray by hitting a tail end of the sheet in a conveying direction against the rear end fence, and a stapling device that executes a stapling operation at an end of a bundle of the sheets. A limiting member is movable in a direction of a thickness of the bundle of sheets stacked on the staple tray, in which a distance between the limiting member and a sheet stacking face of the staple tray guiding the sheet to the rear end fence is variable. The sheets are processed by a method including the steps of receiving a sheet discharged from the image forming apparatus, guiding the sheet to a rear end fence of a staple tray, stacking the sheet on the staple tray, aligning the sheet by hitting a tail end of the sheet against the rear end fence, pressing the tail end of the sheet in a direction of the thickness of the sheet, and stapling the bundle of sheets at the tail end of the sheet aligned by the rear end fence.

23 Claims, 19 Drawing Sheets

SHEET PROCESSING APPARATUS AND METHOD THEREFOR

BACKGROUND OF THE INVENTION

1. Field of the Invention

The present invention relates to a sheet processing apparatus that is connected to an image forming apparatus or a sheet processing apparatus in which the image forming apparatus is built in, such as a copying machine, a printer, a facsimile machine, and the like for processing a sheet discharged from a sheet discharging section thereof.

2. Discussion of the Background

Conventionally, in a case of a sheet processing apparatus which is connected to an image forming apparatus, or a sheet processing apparatus in which the image forming apparatus is built in, which receives a copied sheet from the sheet discharging section of the image forming apparatus, and which discharges the bundle of sheets towards a sheet discharging tray after stapling the sheets stacked on a staple tray as a bundle of a predetermined number of the sheets, tail end portions of the stacked sheets are vertically aligned by a rear end fence, and the side end portions of the sheets are laterally aligned by a pair of jogger fences. The sheet processing apparatus provided with the aforementioned construction has a staple unit that moves to a predetermined position of the tail end portion of the sheet, and staples the sheets at one position or two positions, as is well known.

On the other hand, the staple tray that stacks the sheets is disposed in an inclined state so that the sheet processing apparatus can be prevented from taking too much horizontal space. In the so inclined staple tray, the weight of the sheets is divided into a stacking direction (thickness direction of the sheet) and a conveying direction (longitudinal direction) of the sheet. The weight of the sheets subtracted from the thickness direction of the sheets is applied to the longitudinal direction of the sheets. When the weight is applied to the longitudinal direction, the sheets bend toward the rear end fence and vertical sheet alignment is thereby deteriorated.

Further, in a sheet processing apparatus capable of accepting a large number of sheets to be vertically aligned and stapled, the clearance in a thickness direction of the sheets within the rear end fence and a pair of jogger fences is increased when stacking a small number of sheets. Accordingly, since the sheets are not stacked along a base face (sheet stacking face) of the staple tray, a curl of the sheets (a state where the sheets separate from the staple tray at a tail end portion of the sheets) or a bending down of the sheets (see FIG. 21) tends to occur and the sheets are not accurately aligned.

FIG. 21 is an illustration showing the sheets bending down in a rear end fence and FIG. 22 is a perspective view showing a bundle of sheets stapled in a deviated state at a tail end portion thereof. A staple unit 11 includes a fixed part 11*a* and a movable part 11*b* that contacts and separates from the fixed part 11*a*. The staple unit 11 staples the sheets with a staple needle contained in the fixed part 11*a* or the movable part 11*b* by pressing the stacked sheets nipped between the fixed part 11*a* and the movable part 11*b*. In the case of stapling flexible sheets, or in the case of stapling sheets in a back-curled state as shown in FIG. 21, the sheets are stacked at a position deviated from the fixed part of the staple unit 11, which is a side of a rear end fence 19 at an end face of the sheets. If stapling is executed in this state, the sheets are stapled while pressed by the movable part of the staple unit 11 and accordingly the end face of the stapled sheets is deviated in an inclined state as shown in FIG. 22, and the vertical alignment of the sheets is deteriorated.

Furthermore, the sheets stacked at the rear end fence 19 of the sheet processing apparatus are guided by a bent guide portion formed by bending the rear end face, after being discharged onto the staple tray from the image forming apparatus and passing through the sheet discharging roller 6. The distance between the sheet discharging roller 6 and the rear end fence 19 is determined by the size of the staple unit 11; the larger the staple unit 11, the farther the distance between the sheet discharging roller and an upper edge of the rear end fence.

Furthermore, when the staple unit 11 is provided with an askew staple function, a larger space is required so that the staple unit 11 can pivot on the basis of the stapling position. Therefore, a distance between the sheet discharging roller 6 and the upper end portion of the rear end fence 19 is made longer. If the distance is made longer, the height of the bent part of the rear end fence should be larger so that the sheet can stably be guided, and if the height of the bent part of the rear end fence is made larger, the tip end of the bent part of the rear end fence cannot keep positional accuracy. Furthermore, the rear end fence 19 does not have a width as wide as the entire width of the sheet conveying path. Accordingly, the farther the distance between the sheet discharging roller 6 and the rear end fence 19 becomes, the harder it becomes to guide the sheet.

Moreover, since the staple tray is inclined, the effect of gravity in stacking the sheets on the staple tray becomes small, and the sheets are not tightly stacked. In other words, stacking efficiency deteriorates.

SUMMARY OF THE INVENTION

Accordingly, an object of the present invention is to provide a sheet processing apparatus capable of executing a reliable stapling step with improved stacking efficiency of the sheets on the staple tray and accuracy of the vertical alignment of the sheets.

A sheet processing apparatus according to the invention includes a staple tray that stacks a sheet discharged from an image forming apparatus, a rear end fence that vertically aligns a sheet stacked on the staple tray, and a stapling device that staples an end of a bundle of sheets that is vertically aligned by the rear end fence. A limiting member is movable in a direction of thickness of the bundle of sheets stacked on the staple tray, and a distance between the limiting member and a sheet stacking face of the staple tray that guides the sheets to the rear end fence is variable.

The stapling device executes stapling operations at an end of a bundle of sheets that is vertically aligned by the rear end fence. A pressure member is movable in a direction of the thickness of the bundle of sheets stacked on the staple tray, in which the limiting member presses an upper face of the sheet adjacent to the rear end fence every time that a predetermined number of sheets is discharged on the staple tray.

The limiting pressure member may be movable in a direction of a bundle of sheets stacked on the staple tray, in which a distance between the limiting member and a sheet stacking face of the staple tray that guides the sheet to the rear end fence is variable. The limiting pressure member presses an upper face of the sheet adjacent to the rear end fence every time that a predetermined number of the sheets is discharged on the staple tray.

The rear end fence is provided with a hitting face which the sheet strikes and a first facing face that faces the sheet stacking face of the staple tray. An elastic sheet guide member may be disposed in either the sheet stacking face of the staple tray or the first facing face so as to press the adjacent portion of the tail end part of the sheet to be vertically aligned by the rear end fence.

A method for processing a sheet includes the steps of receiving a sheet discharged from an image forming apparatus, guiding a sheet to a rear end fence of a staple tray, stacking the sheet on the staple tray, aligning the sheet by striking a tail end of the sheet against the rear end fence, pressing the tail end of the sheet in a direction of thickness of the sheet, and stapling a bundle of sheets at the tail end of the sheet aligned by the rear end fence.

BRIEF DESCRIPTION OF THE DRAWINGS

A more complete appreciation of the invention and the attendant advantages thereof will be readily obtained by referring to the following detailed description when considered in connection with the accompanying drawings, wherein.

DESCRIPTION OF THE PREFERRED EMBODIMENTS

Figure 1:
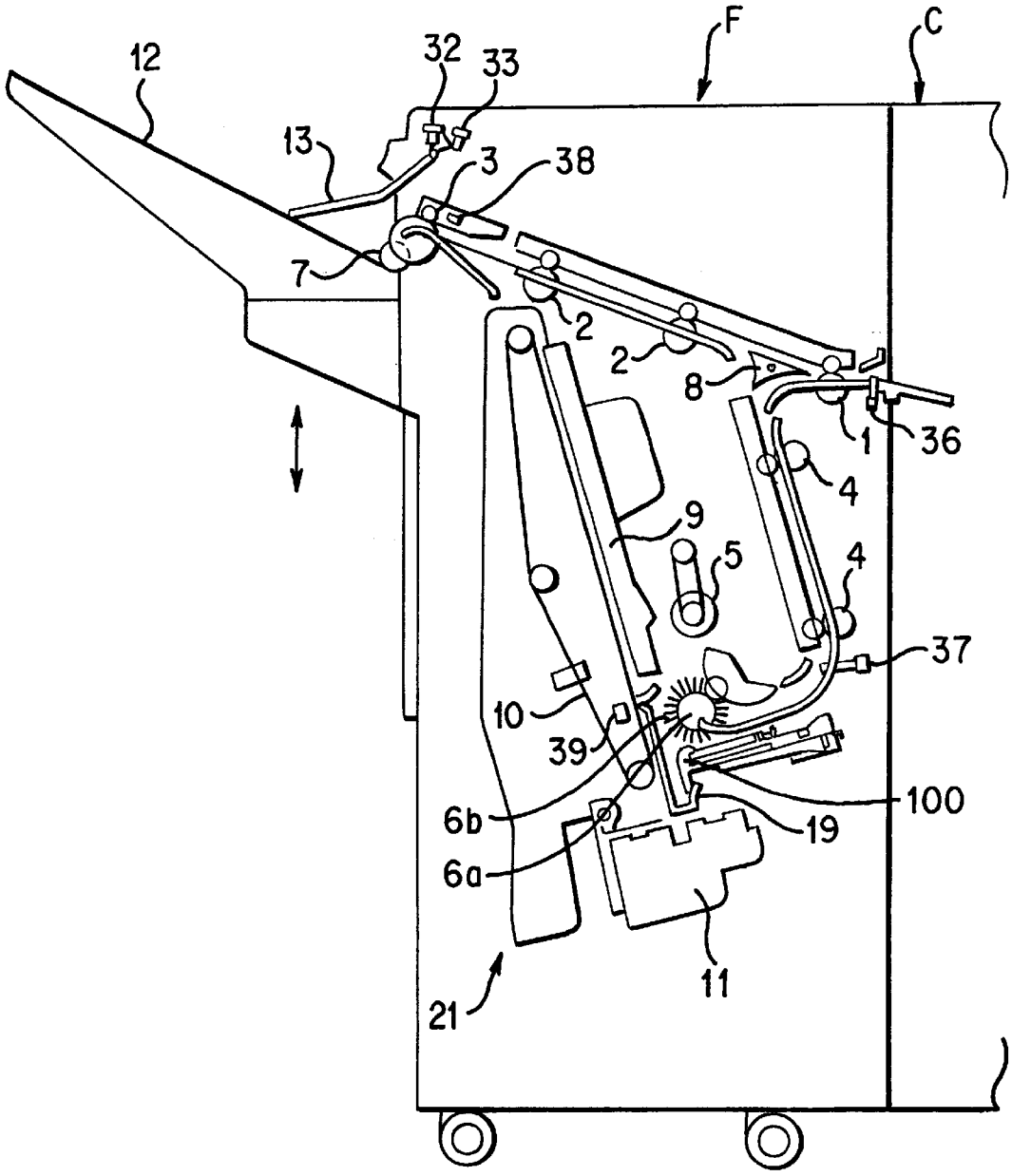
FIG. 1 is a side view of a sheet processing apparatus according to the present invention.

Embodiments of the present invention are hereinafter explained referring to the accompanied drawings. In FIG. 1, a copying machine C comprises an image forming apparatus, and a sheet processing apparatus F is connected to the copying machine C. A sheet entrance sensor 36, an entrance roller 1 and a selecting pick 8 are mounted at an entrance part of a sheet discharging path in the sheet processing apparatus F, through which the sheets can be alternately switched by the selecting pick to proceed to either a sheet discharging tray 12 or a staple unit 11.

The portion of the sheet discharging path for the sheet discharging tray 12 includes a plurality of upper conveying roller pairs 2, a sheet discharging sensor 38, a sheet discharging roller pair 3 for the sheet discharging tray 12, a moving roller 7 for moving a sheet mounted on a sheet discharging tray 12 towards one side, a sheet face lever 13 that moves up and down while contacting an upper face of the sheet discharging tray 12 or an uppermost face of a sheet mounted on the sheet discharging tray 12, and sheet face sensors 32 and 33 that detect a height of the uppermost face of the mounted sheets on the sheet discharging tray 12 by detecting a position of the sheet face lever 13, or the like. The portion of the sheet discharging path for the staple unit 11 includes a plurality of lower conveying roller pairs 4, a sheet discharging sensor 37, a sheet conveying roller 6*a* as a sheet discharging roller, a fur brush roller 6b disposed on the same shaft as the sheet conveying roller 6*a,* or the like.

The lower sheet conveying roller pairs 4 are driven by a sheet conveying motor, and the sheet discharging tray 12 can move up and down, and right and left (perpendicular to the sheet in FIG. 1, i.e., perpendicular to the sheet discharging direction to the sheet discharging tray 12). The staple unit 11 is beneath a staple tray 21 disposed in an inclined posture as shown in FIG. 1.

The pair of jogger fences 9 that can move in a reciprocating motion perpendicular to the sheet conveying direction for aligning the sheet discharged onto the staple tray 21, and a return roller 5 that presses the sheet against the rear end fence 19 (described later), conveying the sheet downwards after contacting an upper face of the sheet discharged onto the staple tray 21, are disposed around the staple tray 21. An expelling belt 10 for discharging a stapled bundle of the sheets on the staple tray 21 is also disposed around the staple tray 21, and the rear end fence 19 against which the tail end of the sheet is pressed for vertical alignment is disposed beneath the pair of jogger fences 9. An expelling belt home sensor 39 detects a home position of the expelling belt 10.

Figure 2:
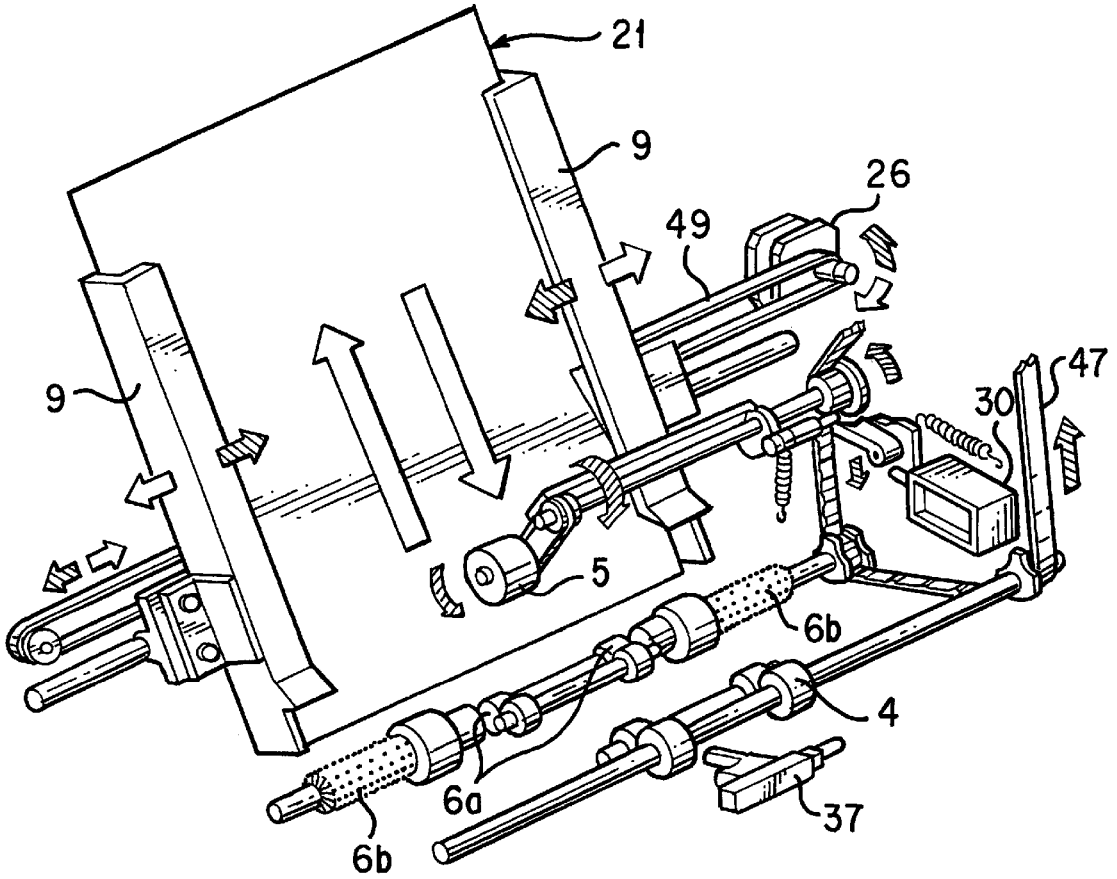
FIG. 2 is a perspective view showing a driving mechanism of a pair of jogger fences and a return roller.
Figure 3:
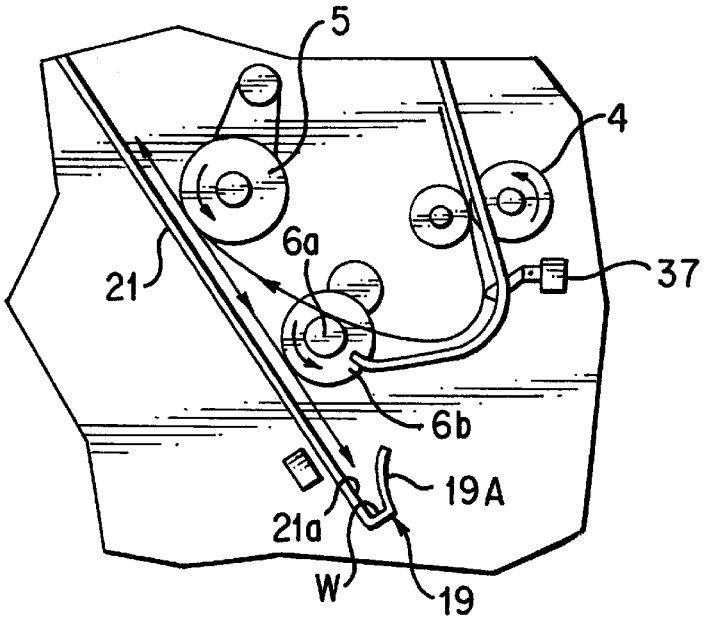
FIG. 3 is an enlarged construction around a rear end fence.
Figure 4:
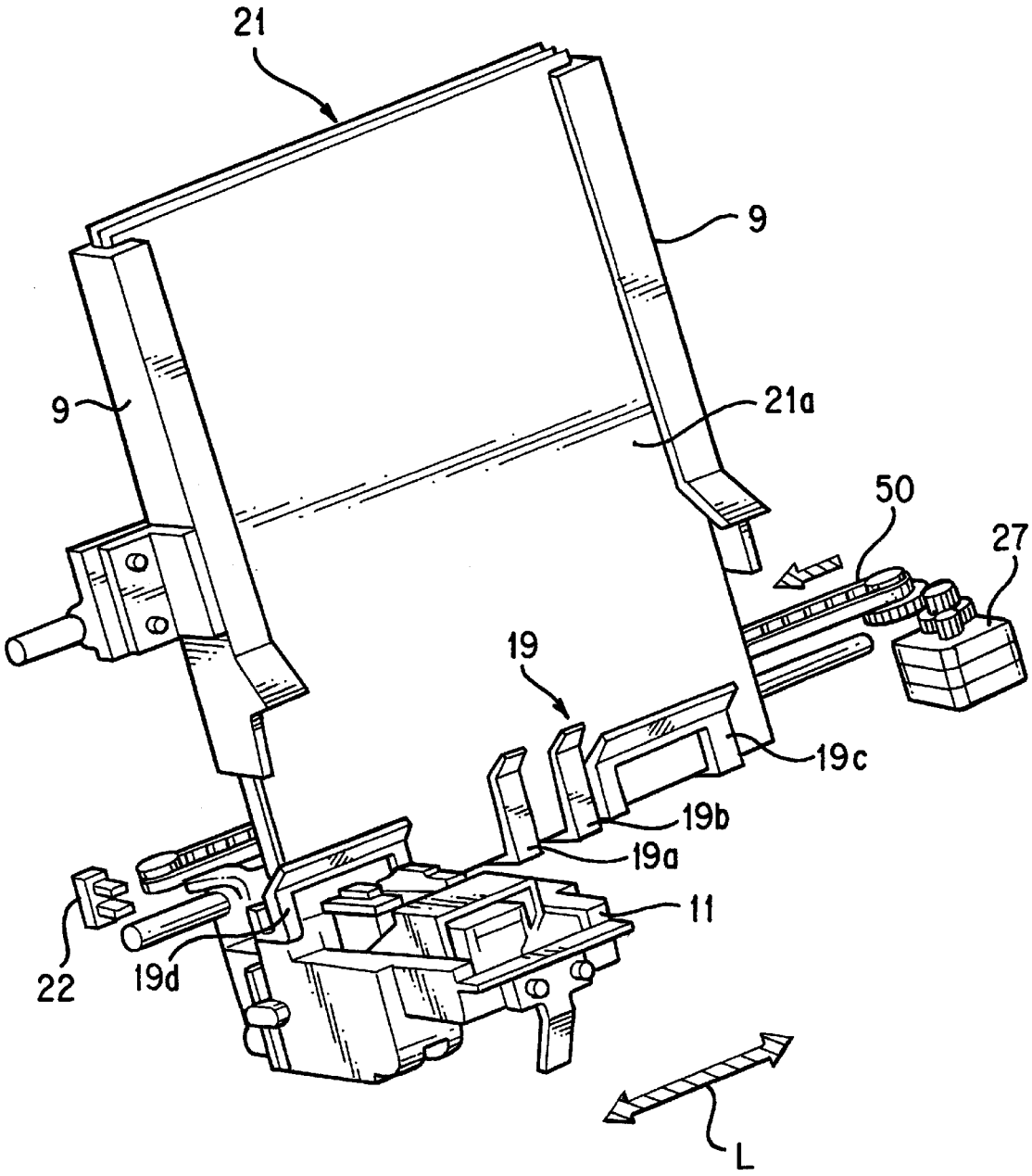
FIG. 4 is a perspective view of a staple unit in the center.

As shown in FIG. 2 the pair of jogger fences 9 are constructed to reciprocate in a sheet width direction via a jogger belt 49 by a jogger motor 26, and the return roller 5 is moved in a swinging motion onto and away from the upper face of the sheet by a return solenoid 30. The return roller 5 conveys the sheet towards the rear end fence 19 when the return roller 5 contacts the upper face of the sheet, rotating counterclockwise as shown in FIG. 3. Further, the sheet discharging roller 6*a* and the fur brush roller 6*b* are rotated counterclockwise by a brush roller belt 47 in FIG. 2. As shown in FIG. 3, the rear end fence 19 provided beneath the pair of jogger fences has a base face W which vertically aligns the tail end of the sheet striking the base face W in a longitudinal direction. Namely, the base face W extends perpendicularly from a lowermost end part of the staple tray 21, and fixed pieces including fixed piece 19*a* are bent upward and perpendicular to the top end portion of the base face W, approximately parallel to the staple tray 21. The fixed piece 19*a* guides a tail end of a sheet that is conveyed downward in the rear end fence 19. Further, as shown in FIG. 4, the staple unit 11 is driven via a staple belt 50 by a stapler moving motor 27 and moves in a width direction indicated by an arrow L. The staple unit movement is such as to avoid a pulley of the expelling belt mounted below a central part of the staple tray 21.

The fixed piece 19*a* and another fixed piece 19*b* are fixed on the base face of the sheet processing apparatus, and movable pieces 19*c* and 19*d* are mounted to move together with the staple unit. The fixed pieces 19*a* and 19*b* are disposed near the center part of a lower end of the staple tray 21, and the movable pieces 19*c* and 19*d* are disposed at both ends of the lower part of the staple tray 21. A stapler home sensor 22 detects a home position of the staple unit 11.

On the other hand, as seen in FIG. 3, the sheet discharging sensor 37 is disposed at a position where the return roller 5 can press the tail end of the sheet, even when the return roller 5 is driven by a solenoid which is turned on by an instruction generated from a controller just after the tail end of the sheet is detected. The bundle of sheets stapled by the staple unit 11 of FIG. 4 is discharged to the sheet discharging tray 12 of FIG. 5 by hooking the tail end of the bundle of sheets at a expelling pick 10*a* mounted on the expelling belt 10, and is conveyed upwards by rotation of the expelling belt 10 driven by the expelling motor 57.

Next, an operation where a nonstaple mode that does not execute stapling is selected by a selecting button in an operation panel (not shown) of a copying machine C is explained with reference to FIG. 1. A sheet discharged from the copying machine C is received by the entrance roller 1, is guided in the conveying path in a direction to the sheet discharging tray 12 by the selecting pick 8 and the upper conveying roller pairs 2, and is discharged onto the discharging tray 12 by the sheet discharging roller pair 3 for the sheet discharging tray 12. Then, the sheet is moved in a direction different from the sheet discharging direction of the sheet by the moving roller 7, and stacked on the sheet discharging tray 12.

Figure 6:
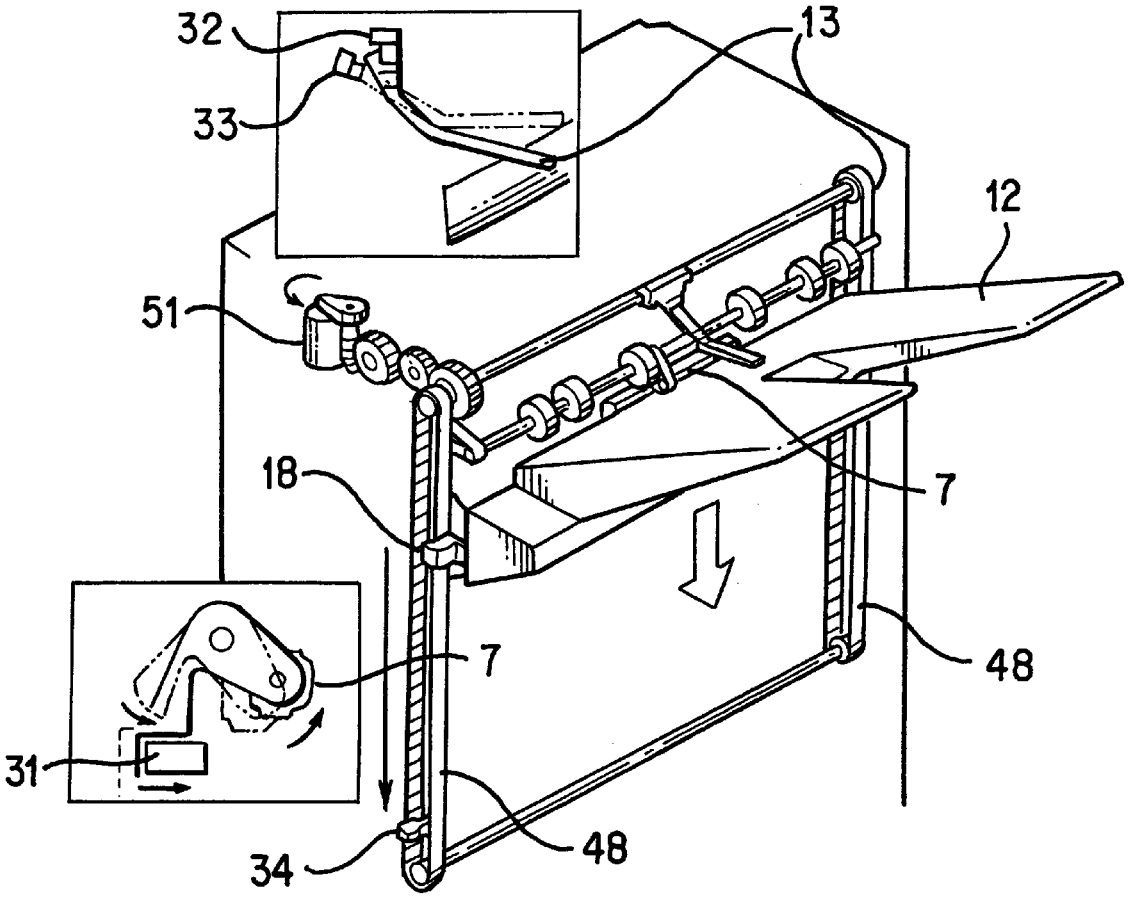
FIG. 6 is a perspective view showing a lifting and lowering mechanism of a sheet discharging tray.

The rotating speed of the sheet discharging roller pair 3 for sheet discharging tray 12 is decreased when the sheet discharging sensor 38 detects the tail end of the sheet, so that overfly of the sheet is prevented and stacking efficiency is improved. Further, as shown in FIG. 6, as the copied sheets are sequentially discharged, the sheet face lever 13 is lifted up (swings up clockwise in FIG. 1), the sheet face sensor 33 detects the sheet face lever 13 and the sheet discharging tray 12 is lowered by driving a lifting-up/lowering-down motor 51, so that the sheet discharging tray 12 is kept at a suitable height.

On the other hand, when the sort and stack mode is selected, the sheet discharging tray 12 is shifted right and left by a shift motor (not shown) and the discharged sheets are sorted until a job ends by a sorting signal generated from a control panel or the like in the main body of the sheet processing apparatus. In addition, when the job ends, the sheet discharging tray 12 lowers down by about 30 mm so that the bundles of sheets can easily be taken off.

Next, returning to FIG. 1, a case in which a staple mode is selected by a selecting button in the operation panel (not shown) in the copying machine C is explained. When a staple mode is selected, the pair of jogger fences 9 move from a home position and wait at a waiting position that is 7 mm distant from each of the sheet side ends of a selected or detected sheet size. A sheet discharged from the copying machine C is received by the entrance roller 1 and guided by the selecting pick 8 in the conveying path to the staple unit 11. The sheet is then conveyed by the lower conveying roller pairs 4 (driven by a conveying motor) and the tail end of the sheet passes the sheet discharging sensor 37 (at this moment, the tip end of the sheet is inserted between the pair of jogger fences, 9). Then, the pair of jogger fences 9, moves inward by 5 mm from the aforementioned waiting position, namely toward the sides of the sheet, and stops (this position is called an interim alignment position).

When the sheet discharging sensor 37 detects the passage of the tail end of the sheet, it inputs a passing signal into a controller. The controller counts the pulse signals generated by rotation of the conveying motor from the time of receiving the aforementioned passing signal. The controller turns on the return solenoid 30 of FIG. 2 after counting a predetermined number of pulse signals, to cause the supporting arm of the return roller 5 to swing. The rotation of the return roller 5 then presses the sheet downwards. The sheets are vertically aligned by the tail end of the sheets striking the rear end fence in FIG. 1. The number of the sheets is counted by the entrance sensor 36 (or the sheet discharge sensor 37) sending a passing signal to the controller. Further, when a sheet is conveyed downwards by the return roller 5, since there is slight clearance of 2 mm between both sides of the sheet and the pair of jogger fences 9, the sheet can smoothly be guided by the pair of jogger fences 9.

After a predetermined time has elapsed from turning off the return solenoid 30 of FIG. 2, the pair of jogger fences 9 move 2 mm further inward from the interim alignment position by the jogger motor 26 and stop, thus completing lateral alignment of the sheets (alignment of the sheets perpendicular to the sheet conveying direction). Thereafter, the pair of jogger fences 9, move 7 mm from the sides of the sheets and await the next sheet. This operation is repeatedly executed until the last page has come. After the last page, the jogging operation to 7 mm inside is again executed to align the sheets and prepare for a stapling operation, thereby keeping both sides of the bundle of sheets supported by the pair of jogger fences 9. Then, as shown in FIG. 4, after a predetermined time period, the staple unit 11 performs the stapling operation. Hereupon, if a plural stapling has been set, the stapler moving motor 27 is driven after one stapling operation and the stapler unit 11 is moved along the tail end of the sheet to the proper position for stapling at the second position on the sheet.

Figure 5:
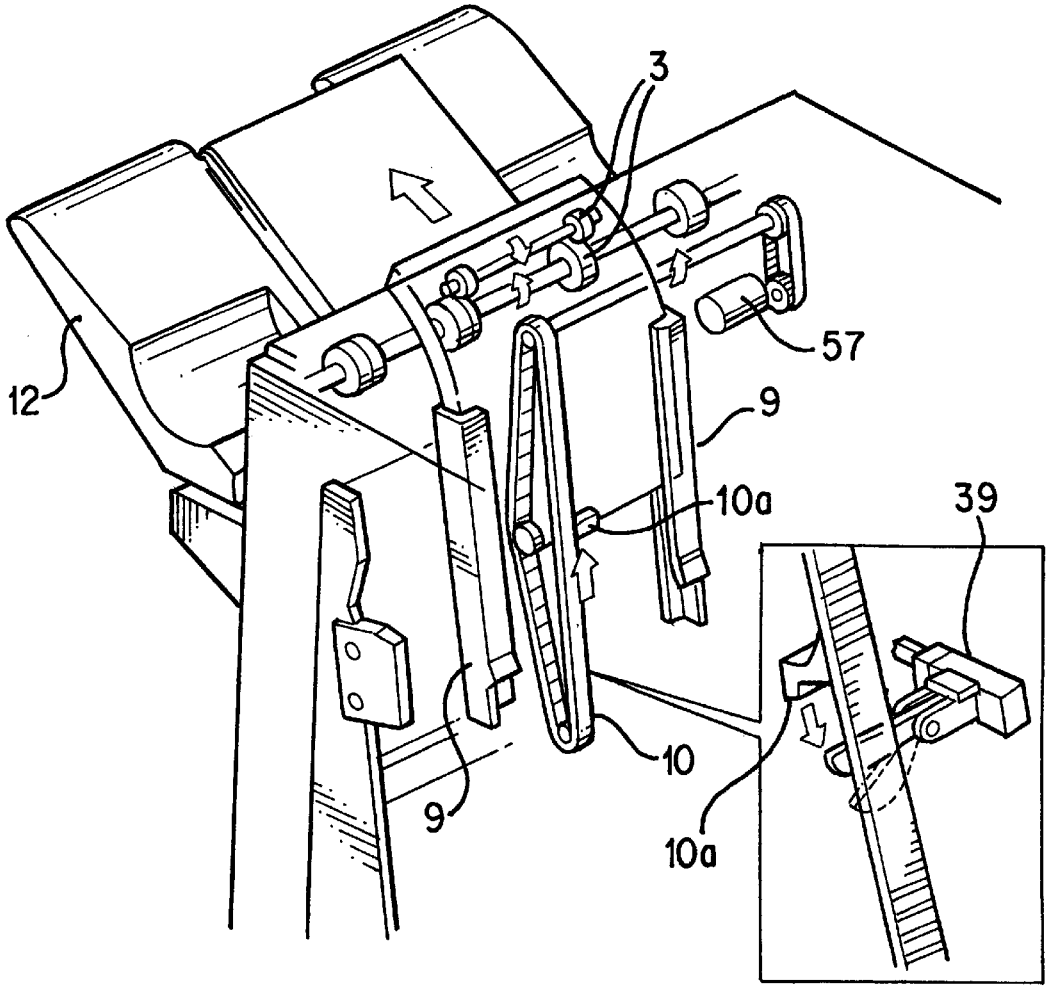
FIG. 5 is a perspective view showing an expelling operation for a bundle of sheets after stapling by an expelling belt.

When the stapling operation is completed, the expelling motor 57 of FIG. 5 is turned on and the expelling belt 10 is driven. Hereupon, a sheet discharging motor (not shown) is also driven and the sheet discharging roller pair 3 starts to rotate for receiving the bundle of sheets that is lifted by the expelling pick 10*a*. At this moment, the operation of the pair of jogger fences 9 is controlled in a different motion for the size and the number of the sheets that is stacked on the staple tray 21 of FIG. 4.

For example, as shown in FIG. 5, in case the number of sheets to be stapled is less than a predetermined number or the size of the sheets to be stapled is smaller than a predetermined size, the bundle of sheets is conveyed while being hooked at the tail end by the expelling pick 10*a*, and supported by the pair of jogger fences 9. In addition, after a predetermined number of pulses from the expelling belt sensor 39 has been counted, the pair of jogger fences 9 is retreated for 2 mm and the bundle of sheets is released. The predetermined number of pulses is set to correspond to a time period from the touching of the expelling pick 10*a* to the tail end of the bundle of sheets to the passing by the same of the end of the pair of jogger fences 9.

Further, when the number of the sheets to be stapled is more than the predetermined number or the size of the sheet to be stapled is larger than the predetermined size, the pair of jogger fences 9 is retreated by 2 mm prior to the expelling operation. In both cases, when the bundle of sheets has finished passing the pair of jogger fences 9, the pair of jogger fences further move 5 mm, returning to the waiting position to prepare for the next sheet. Furthermore, the clamping force of the sheet can be adjusted, depending on the distance between the sides of the sheet and the pair of jogger fences 9. The aforementioned operations are repeated until the last job has been completed.

FIG. 6 is a perspective view showing a lifting-up and lowering-down mechanism of the sheet discharging tray 12. The sheet discharging tray 12 is supported with two lifting-up and lowering-down belts 48. The lifting-up and lowering-down belts 48 are driven by the lifting-up and lowering-down motor 51 via a gears and timing belt, and are lifted up and lowered down by rotation of the lifting-up and lowering-down motor 51. A height of the home position of the sheet discharging tray 12, and the height of a the moving sheet discharging tray 12 is detected by the sheet face lever 13 that is movable upwards and downwards and the sheet face sensors 32 and 33 that detect the position of the sheet face lever 13, and the sheet discharging tray 12 is moved corresponding to the detection. Further, when the sheets on the sheet discharging tray 12 reach a maximum stacking amount, a lowermost limitation sensor 34 detects this position. In addition, if the moving roller 7 is pushed up by the sheet discharging tray 12 when the sheet discharging tray 12 is lifted up, an uppermost limit switch 31 is turned off and the lifting-up and lowering-down motor 51 stops rotation, and so the drive system is prevented from damage due to overrun of the sheet discharging tray 12.

Figure 7:
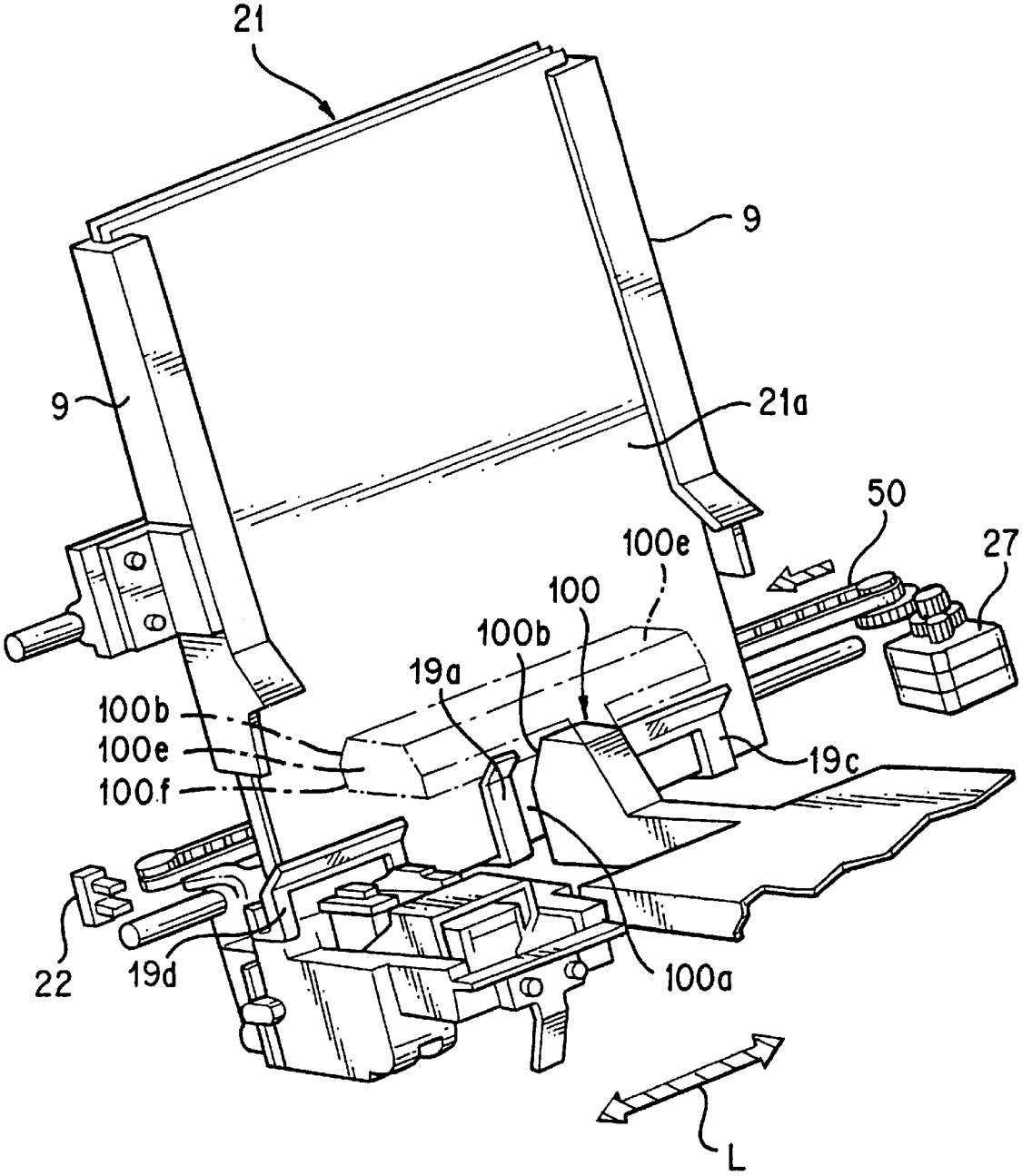
FIG. 7 is a perspective view showing a staple tray to which a first embodiment of the present invention is applied.
Figure 8B:
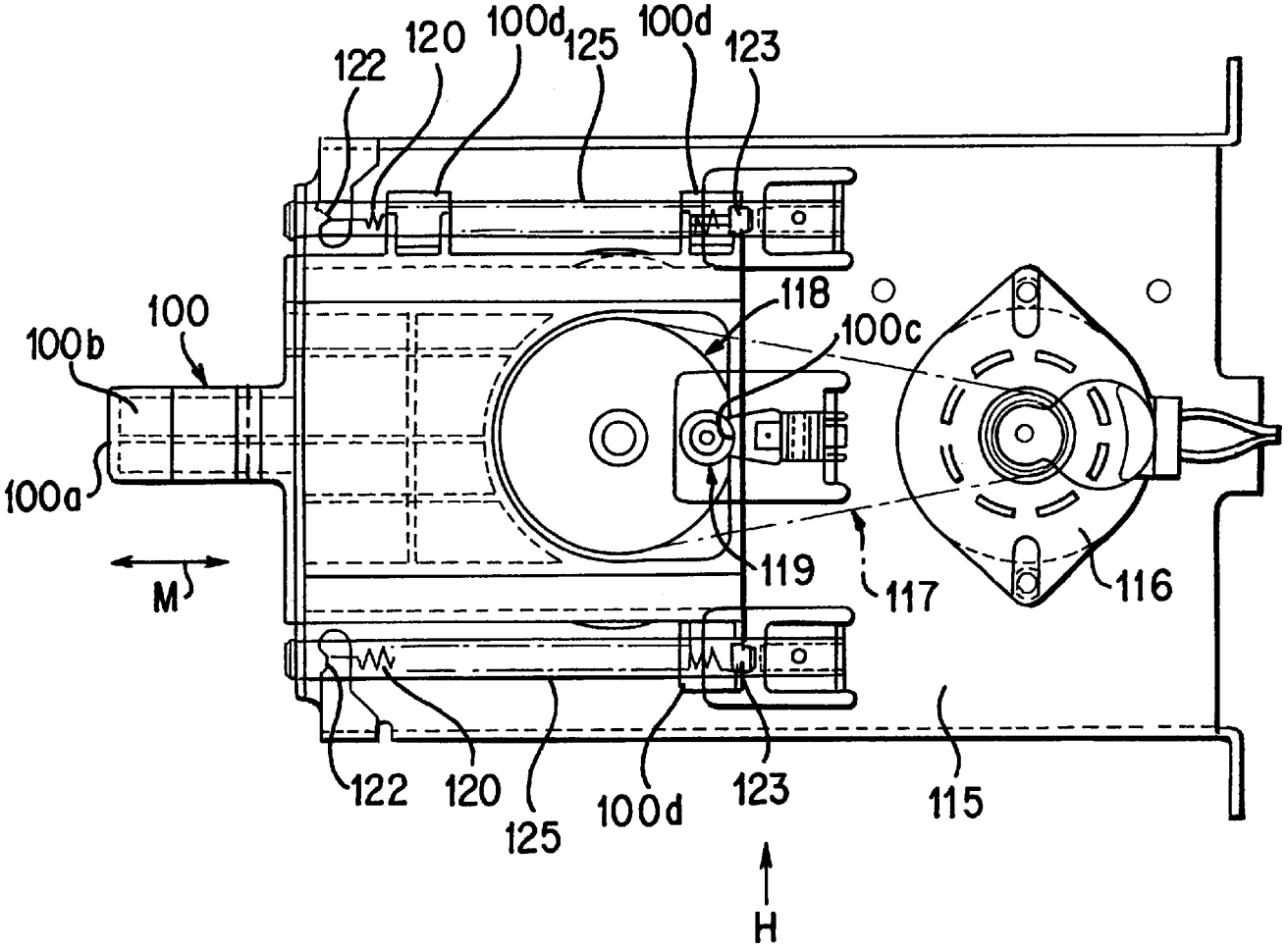
FIG. 8B is a top plan view showing the first embodiment.
Figure 9:
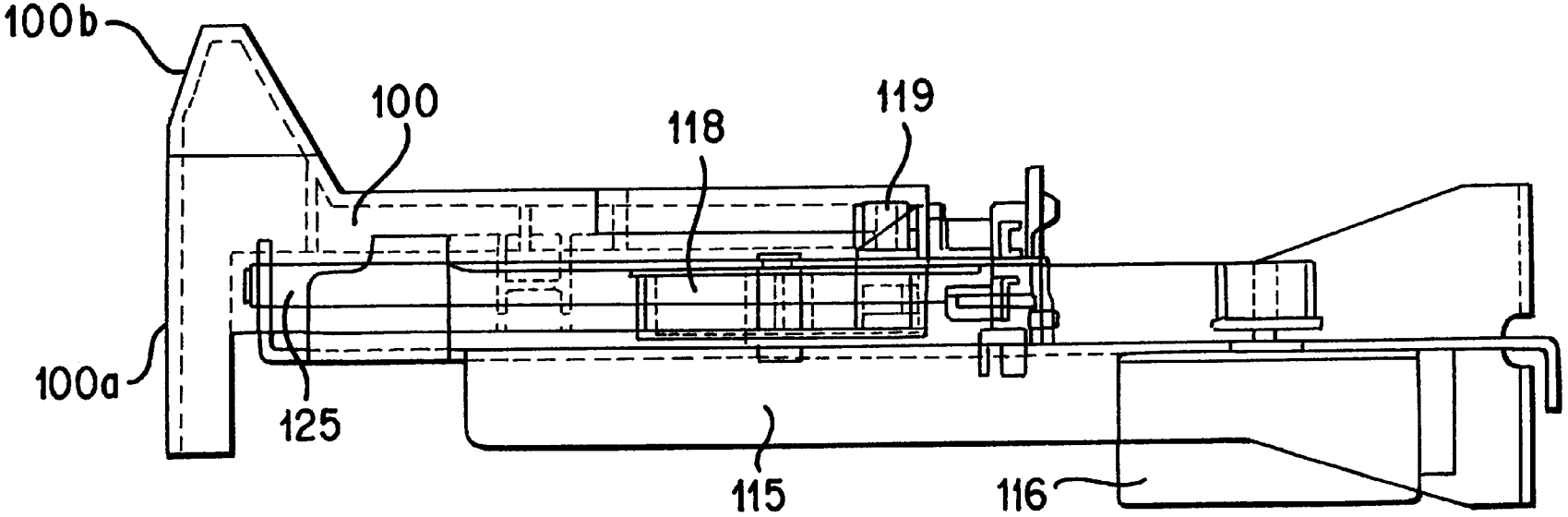
FIG. 9 is an explanatory view looking in the direction of an arrow H in FIG. 8B.

Next, a first embodiment of the control according to the present invention is explained. Referring to FIG. 7, a limiting pressure member 100 has a T shaped configuration, as seen in FIG. 9, and has a width such that it is capable of being inserted in a gap between fixed pieces 19*a* and 19*b* shown in FIG. 4. In addition, a sheet limiting pressure face 100*a* that is approximately parallel to the sheet stacking face 21*a* (see FIG. 7) of the staple tray 21 is provided at a tip end portion of the limiting pressure member 100, and an inclining sheet guide face 100*b* that is inclined to the thickness direction and is distanced from the sheet stacking face 21*a* is formed at the upper end portion of the sheet limiting pressure face 100*a*. Furthermore, as seen in FIG. 8B, guide arms 100*d* project from the limiting pressure member 100. The guide arms 100*d* are guided by guide shafts 125 that are fixed on a bracket 115 as shown in FIGS. 8B and 9. The limiting pressure member 100 is movably supported between the guide shafts for movement along the lengths of the guide shafts 125. In other words, the limiting pressure member 100 is movably supported for movement in a direction of right to left (indicated by an arrow M) in FIG. 8B.

Figure 10:
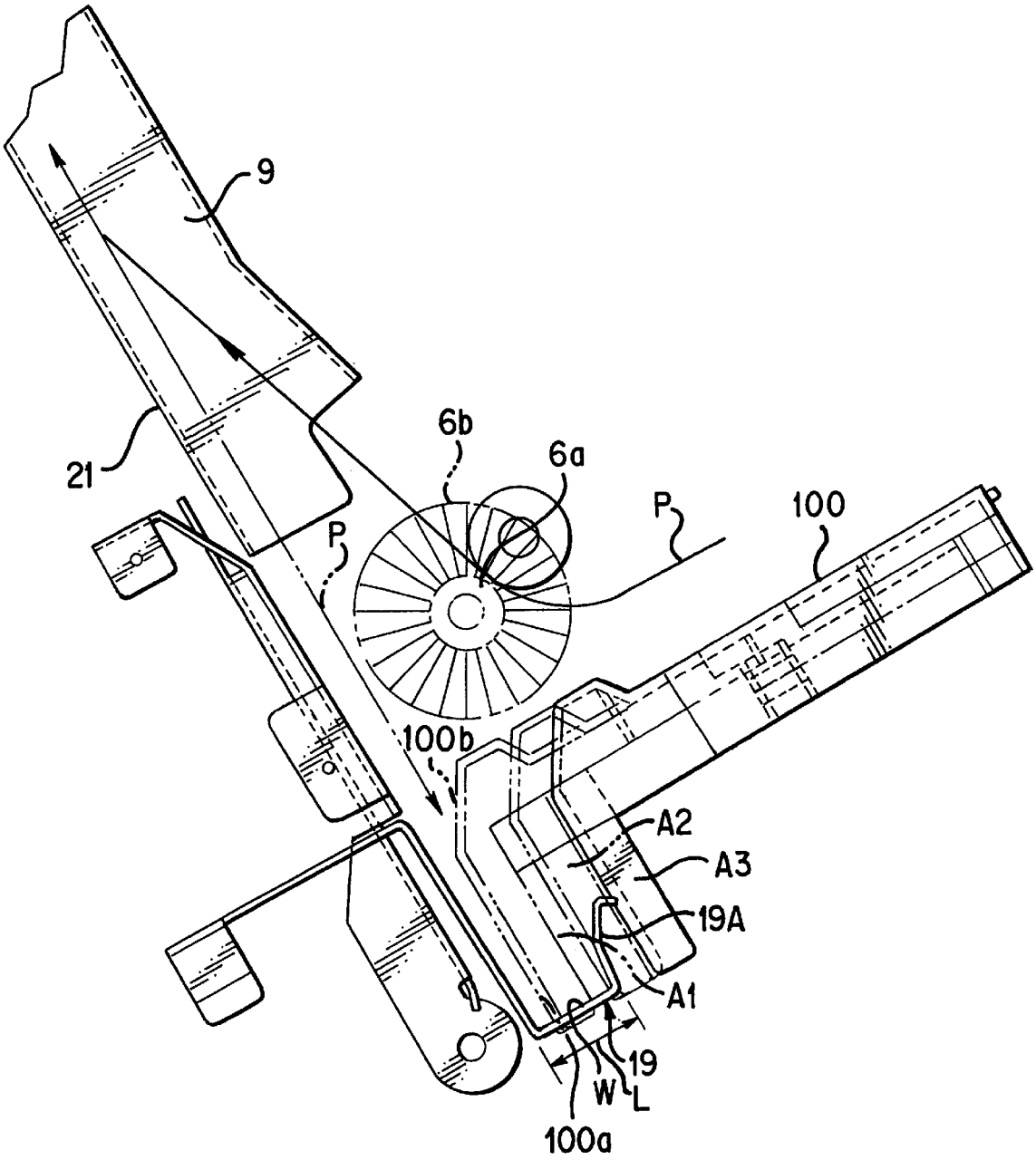
FIG. 10 is an explanatory view showing each stop position of a pressing member at a first control operation in the first embodiment.

The limiting pressure member 100 is energized in the left direction in FIG. 8B, namely toward the staple tray 21 in FIG. 10, by an extension spring 120 that is hooked at an end thereof to a hooking portion of the bracket 115, and at another end thereof to a hooking portion 123 of the limiting pressure member 100. A drive motor 116 that is capable of rotating forward and backwards is mounted on the bracket 115 and a driving force of the drive motor 116 is transmitted to a timing pulley 118 via a timing belt 117 as shown in FIG. 8B. An eccentrically mounted boss 119 extends from the timing pulley 118, and is engaged with a contacting portion 100*c* of the limiting pressure member 100 by an energizing force of the extension spring 120.

As the timing pulley 118 rotates counterclockwise and the boss moves left in FIG. 8B, the limiting pressure member 100 follows the displacement of the boss 119 due to the energizing force of the extension spring 120. Namely, the limiting pressure member 100 moves left (or right) in FIG. 8B due to contact between the boss 119 and the contacting portion 100*c*, corresponding to the displacement of the boss 119 and the energizing force of the extension spring 120.

If the boss 119 is rotated by an angle of 120° counterclockwise from the state of FIG. 8B, the boss 119 moves to a position where the limiting pressure member 100 contacts the sheet stacking face 21*a* of the staple tray 21 in FIG. 7. Further, the position where the limiting pressure member 100 contacts the sheet stacking face 21*a* of the staple tray 21 is kept while the boss 119 of FIG. 8B further rotates in an angle of 60°. Namely, the position where the limiting pressure member 100 contacts the sheet stacking face 21*a* of the staple tray 21 in FIG. 7 is kept by an energizing force of the extension spring 120 of FIG. 8B, while the boss 119 separates from the contacting portion 100*c*. Next, if the boss 119 is rotated clockwise (contrary direction) by an angle of 120° to the home position, the boss 119 contacts the contacting portion 100*c*, which is moved right in FIG. 8B against the energizing force of the extension spring 120, and the limiting pressure member 100 returns to the home position.

Further, the limiting pressure member 100 presses a bundle of sheets (not shown in FIG. 7) on the sheet stacking face 21*a*. This pressure is accomplished by the energizing force of the extension spring 120 of FIG. 8B, after the further movement of the boss 119 toward the stacking face 21*a* of FIG. 7 causes the boss 119 of FIG. 8B to separate from the contacting portion 100*c*. Further, the limiting pressure member 100 is returned to stop positions A1, A2, and A3 FIG. 10 by a movement of the boss 119 towards the right in FIG. 8B after the pressing operation and before the next sheet P of FIG. 10 is discharged. The vertical alignment of the sheet P on the staple tray 21 is thus achieved by a sequential alignment operation in the thickness direction of a plurality of sheets P and a pressing operation.

Hereupon, a pressing operation at the tail end of the bundle of sheets P, and a sheet guidance to the rear end fence 19 of the present invention is explained. The guidance of a sheet that is discharged to the staple tray 21 is executed before the tail end of the sheet P reaches the rear end fence 19, and the pressing of the bundle of sheets P is executed after the sheet P that is discharged to the staple tray 21 has reached the rear end fence 19 and before the staple operation.

Figure 11:
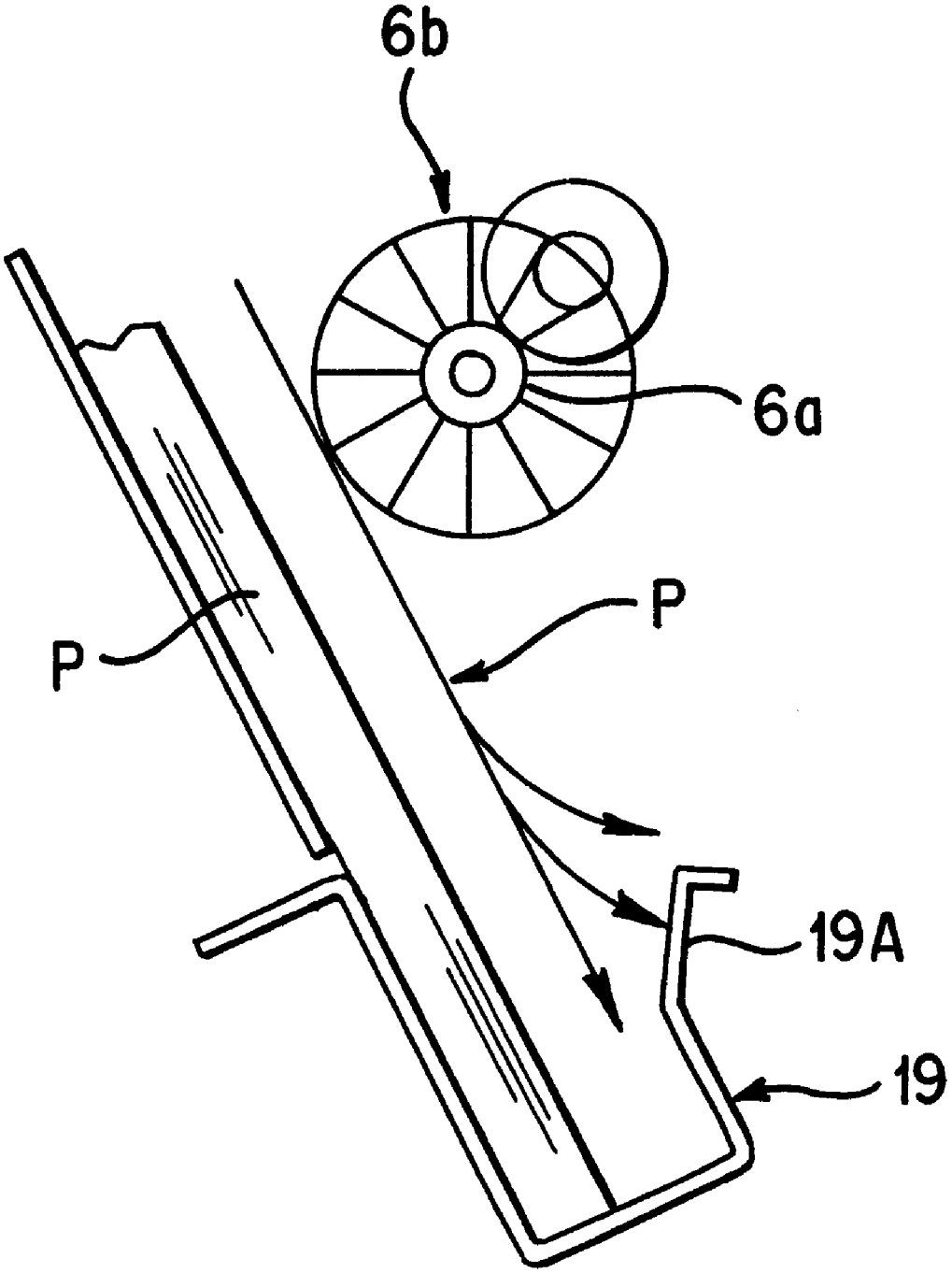
FIG. 11 is an explanatory view showing a guide part of the rear end fence where a sheet deviates from the staple tray.

Next, the stop position (guide position) of the limiting pressure member 100 is explained. If the distance between the sheet discharging roller 6*a* and the fur brush roller 6*b*, and the tip end portions of the bent guide parts 19A of the fixed and movable parts 19*a*–19*d* is too great, the sheet P is not guided into the bent guide part 19A of the rear end fence 19 due to the curl or an excursion of the dropping sheet, and it falls outside of the rear end fence 19 as shown in FIG. 11. Accordingly, as seen in FIG. 10, the inclining sheet guide face 100*b* of the limiting pressure member 100 guides the dropping sheet P into the rear end fence 19.

The sheet limiting pressure face 100*a* and the inclining sheet guide face 100*b* of the limiting pressure member 100 are formed between the sheet discharging roller 6*a* and the fur brush roller 6*b*, and the rear end fence 19 covering almost the entire area as shown in FIG. 10. In other words, the sheet limiting pressure face 100*a* and the inclining sheet guide face 100*b* of the limiting pressure member 100 are disposed over almost the entire area between the sheet discharging roller 6*a* and the fur brush roller 6*b,* and the part of the rear end fence 19 under the staple tray 21.

The limiting pressure member 100 is capable of stopping at any of the stop positions (guide position) A1, A2, and A3 shown in FIG. 10. When the sheet processing apparatus begins to operate and the sheet P is discharged to the staple tray 21 by the sheet discharging roller 6*a,* the sheet limiting pressure face 100*a* of the limiting pressure member 100 will move to a first stop position (guide position) denoted by A1 if the boss 119 of FIG. 9 rotates 90° from the home position, a second stop position (guide position) denoted by A2 in FIG. 10 if the boss 119 of FIG. 9 rotates from the home position, or a third stop position (guide position) denoted by A3 in FIG. 10 if the boss 119 of FIG. 9 remains in the home position, depending on the number of stacked sheets P. Further, as seen in FIG. 10, the sheet P dropping onto the staple tray 21 is guided by both the inclining sheet guide face 100*b* and the sheet limiting pressure face 100*a*.

The stop position (guide position) of the sheet limiting pressure face 10*a* of the limiting pressure member 100 is selected from the aforementioned three positions based on the number of sheets P to be stacked. When the number of the sheets P is small (for example, less than 35 sheets), the limiting pressure member 100 takes the first stop position (guide position) in which the limiting pressure member 100 is closest to a bottom face of the staple tray 21. When the number of the sheets P is moderate (for example, 35 to 70 sheets), the limiting pressure member 100 takes the second position in which the limiting pressure member 100 is more distant from the bottom face of the staple tray 21 than in the first stop position (guide position). When the number of the sheets P is large (for example, 70 to about 100 sheets), the limiting pressure member 100 takes the third stop position (guide position) in which the limiting pressure member 100 is most distant from the bottom face of the staple tray 21.

After each sheet P is guided to the rear end fence 19, the limiting pressure member 100 is advanced by a predetermined distance, and the upper face of the bundle of sheets P is pressed by the sheet limiting pressure face 100*a* to enhance the stacking efficiency of the sheets. Since the stop position (guide position) of the limiting pressure member 100 is selected corresponding to the number of the sheets P, the time for the pressing operation can be kept constant regardless of the number of the sheets P to be stacked. Therefore, the CPM (Copy Per Minute) can be high, even for pressing a small number of sheets.

Further, since the stop position (guide position) of the limiting pressure member 100 is selected corresponding to the number of sheets P, an appropriate sheet guiding depth corresponding to the number of stacked sheets can be obtained regardless of the length in the sheet stacking direction L (See FIG. 10) of the base face W of the rear end fence 19. Furthermore, the selecting of the stop positions (guide position) A1, A2, and A3 in the limiting pressure member 100 is preferably realized by using a stepping motor for the drive motor 116 (as used in FIG. 9) for controlling the rotating angle of the timing pulley 118. In another construction, the drive motor 116 can be controlled by detecting the position of the limiting pressure member 100 by a sensor. Furthermore, the limiting pressure member 100 may function to execute limitation and pressing of the stacked sheets, may be a limiting member that executes just limitation for the stacked sheets, or may be a pressure member that executes just pressing the stacked sheets. Therefore, the name of the parts corresponds to the function.

Figure 13:
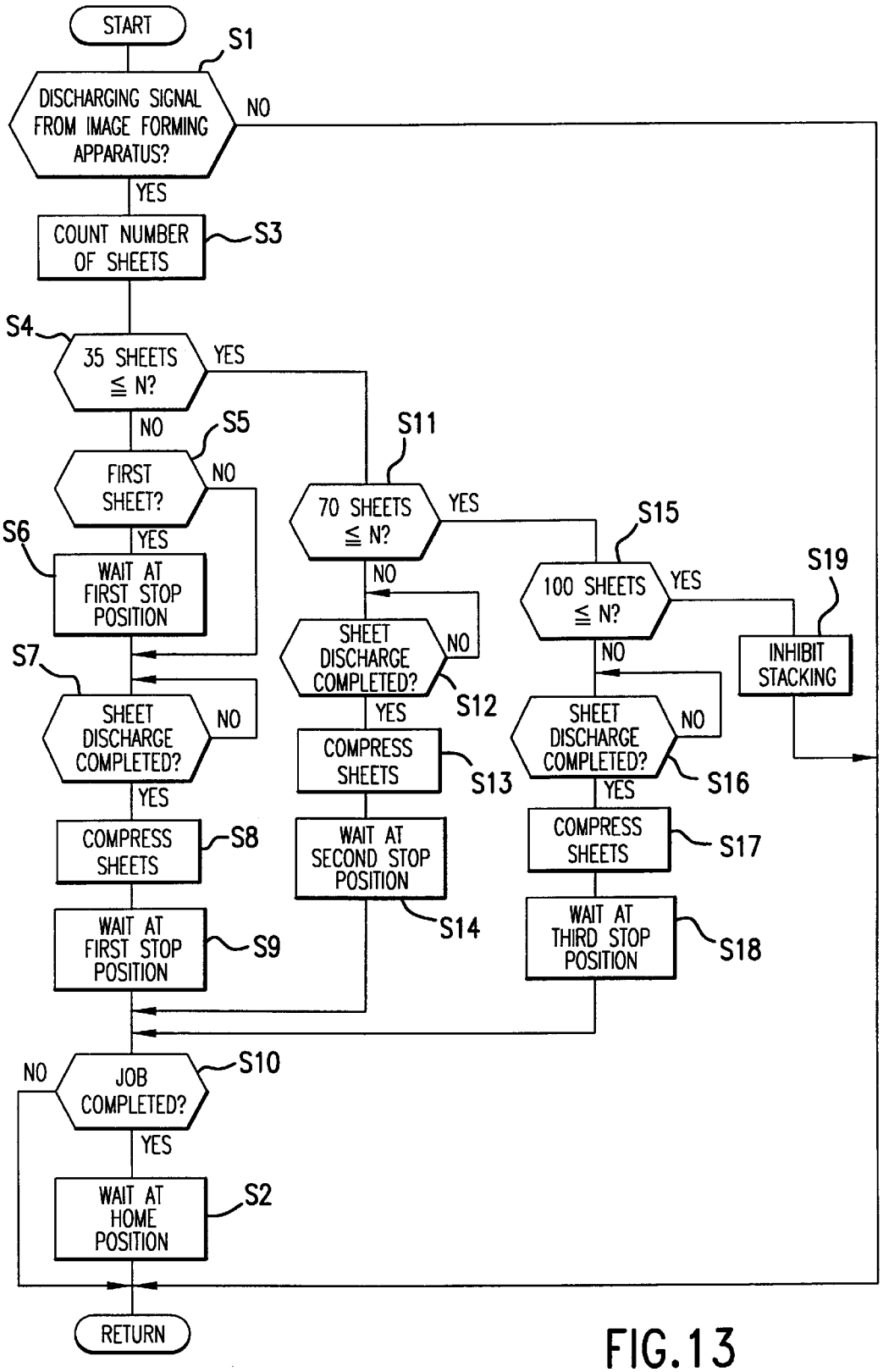
FIG. 13 is a flowchart showing a first control operation.
Figure 16C:
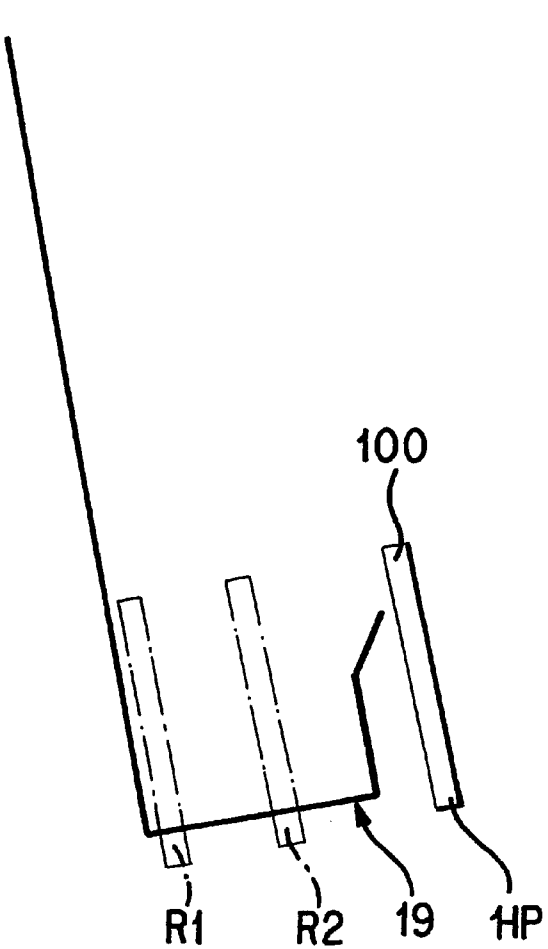
FIGS. 16A through 16C are models showing each stop position of the pressing member in the first to third control operations.
Figure 16B:
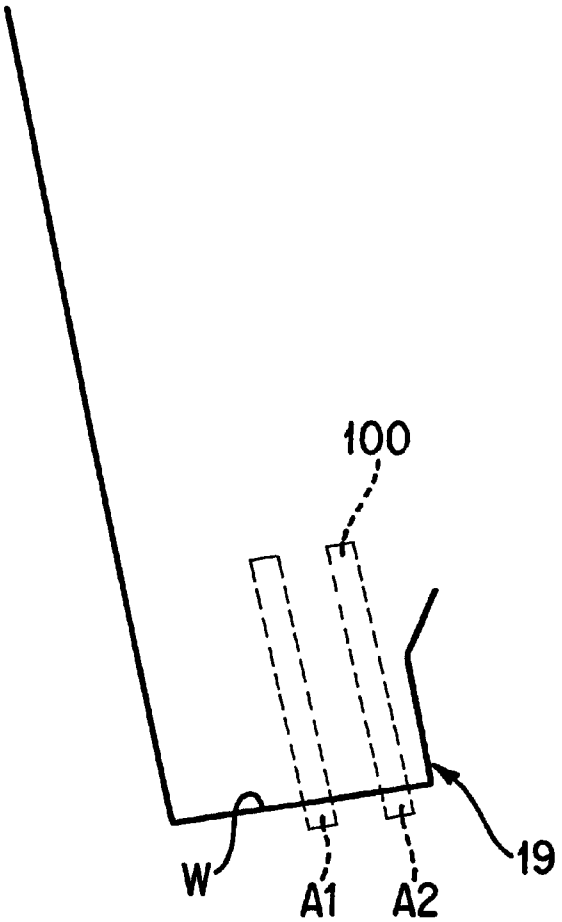
Figure 16A:
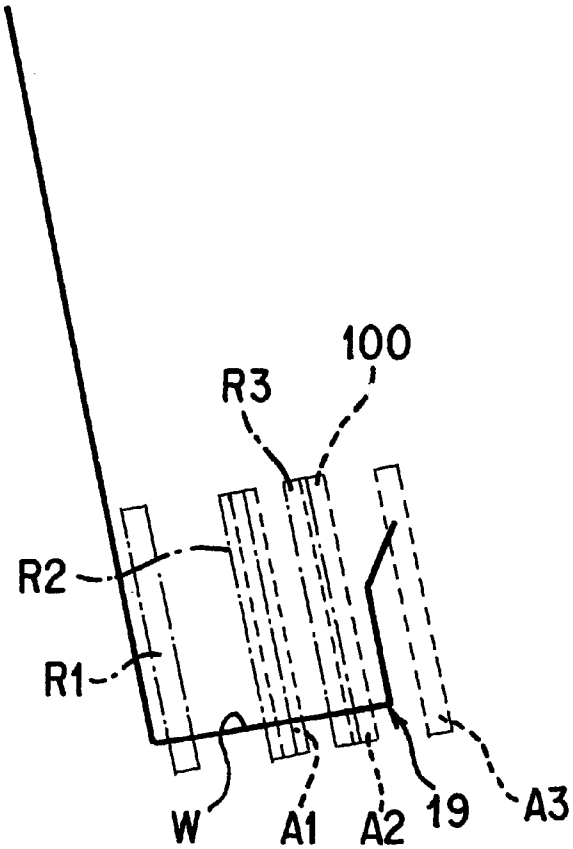

Next, a control operation for limiting and pressing the stacked sheets in the first embodiment is explained referring to a flowchart in FIG. 13 and to the structure in FIG. 16A. FIG. 13 is a flowchart relevant to a control of the limiting pressure member. A stop position (guide position) and a pressing position are controlled according to a number of the stacked sheets, by counting a sheet discharging signal from the main body of the image forming apparatus. In the first control operation, since the maximum number of the stacking sheets is 100 sheets, the stop position is controlled in three steps. First, the controller checks for a sheet discharging signal from the main body in Step S1. If there is no sheet discharging signal from the main body (NO in Step S1), then the program returns. If a sheet discharging signal is present (YES in Step S1), the controller counts the number of the sheet being conveyed through the conveying path by the passing signal from the sheet discharging sensor (Step S3). If the number of the sheet that is discharged from the main body of the image forming apparatus is less than 35 (NO in Step S4), and it is the first sheet (YES in Step S5), the limiting pressure member 100 of FIG. 16A is moved from the home position to the first stop position (guide position) A1 to wait (See FIGS. 10 and 16A) by rotating the boss 119 at a forward angle of 90° from the home position by driving the drive motor 116 of FIG. 9 (Step S6).

In addition, since the limiting pressure member 100 of FIG. 16A is stopped at the first stop position A1 to await an operation described later, Step S6 is not executed after the second sheet (NO in Step S5) because the limiting pressure member 100 is waiting at the first stop position A1 according to the operation as described later. Then, as seen in FIG. 10, the sheet P is discharged onto the staple tray 21 from the sheet discharging roller 6*a,* being guided by the limiting pressure member 100 at the first stop position (guide position) A1.

Even though there is a curl or the like at the tail end of the sheet P, the sheet P is guided by the fur brush roller 6*b* to the rear end fence 19 as described before. The sheet P also is conveyed in the direction of the rear end fence 19 by the return roller 5 of FIG. 1–3, and the tail end thereof strikes the base face W of the rear end fence 19 in FIG. 16A, and so the sheets are vertically aligned.

Next, returning to FIG. 13, if the sheet discharging operation is completed and a predetermined time has elapsed since the tail end of the sheet was detected by, e.g., the sheet discharging sensor (YES in Step S7), the limiting pressure member 100 is moved to the first pressing position R1 (See FIG. 16A) by moving the same towards an upper face of the sheet P in the staple tray 21 of FIG. 10, rotating the boss 119 of FIG. 9 in an angle of 90° from the first stop position with the drive motor 116. The pressing of the upper face of the tail end of the sheet P discharged onto the staple tray 21 in FIG. 10 is thus executed by the movement of the limiting pressure member 100 (Step S8).

Next, the boss 119 of FIG. 9 is rotated back by 90° from the first pressing position R1 of FIG. 16A so that the limiting pressure member 100 retreats from the first pressing position R1 (distancing from the upper face of the sheet) and is stopped at the first stop position A1 to wait (Step S9). Then, if the job is not completed (NO in Step S10), the program returns, and if the job is completed (YES in Step S10), the limiting pressure member 100 moves to the home position HP in FIG. 16C to wait (Step S2) and the program returns. Namely, if the number of sheets discharging to the staple tray 21 in FIG. 10 is less than 35 (YES in Step S4), the sheet P is guided to the rear end fence 19 by the limiting pressure member 100 that is waiting at the first stop position (guide position) A1. In addition, the limiting pressure member 100 is moved from the first stop position A1 to the first pressing position R1 (See FIG. 16A), and repeats the pressing operation to the sheet P (Steps 1 to 10).

If the number of sheets discharged from the main body of the image forming apparatus is 35 or greater, and less than 70 (YES in Step S4, and NO in Step S11) in FIG. 13, after completing the discharging operation, and when the discharged sheet is, for example, the 35th sheet, and when the predetermined time periods has elapsed (YES in Step S12) from the time when the tail end of the sheet is detected by the sheet discharging sensor, the boss 119 of FIG. 8B is rotated in the forward direction in an angle of 90°, and so the pressing operation to the upper face of the tail end of the sheet is executed by the limiting pressure member 100 (Step S13) in FIG. 13.

Thereafter, the limiting pressure member 100 moves to a second stop position A2 to wait (See FIGS. 10 and 16A) by rotating the boss 119 of FIG. 8B back by an angle of 120° from the first pressing position R1 (Step 14 in FIG. 13). In other words, the limiting pressure member 100 in FIG. 10 distances from the upper face of the sheet P. Further, if the number of the sheet P that is discharged from the main body of the image forming apparatus is more than 35 and less than 70, the pressing operation to the upper face of the tail end of the sheet P is executed using the limiting pressure member 100 by rotating forward at an angle of 90°. Thereafter, the limiting pressure member 100 is returned to the second stop position A2 by rotating the boss 119 of FIG. 8B back by 90°. The next sheet is guided to the rear end fence 19 of FIG. 10 by the limiting pressure member 100 at the second stop position (guide position) in a manner as stated above. Further, as seen in FIG. 13, the program returns if the job is not completed (NO in Step S10), and if the job is completed (YES in Step S10) the limiting pressure member 100 of FIG. 16C is returned to the home position HP to wait (Step S2), and the program returns.

If the number of the sheet discharged from the main body of the image forming apparatus is 70 or more, and or less than 100 (YES in Step S11, and NO in Step S15 in FIG. 13), and is, for example, the 70th, after a predetermined time period has elapsed (YES in Step S16) from the time when the tail end of the sheet is detected by the sheet discharging sensor, the pressing operation for the upper face of the tail end of the sheet is executed by the limiting pressure member 100 by rotating the boss 119 of FIG. 8B in a forward rotation of 90° from the second stop position A2 of FIG. 10 (Step S17). Then, the limiting pressure member 100 is moved to the third stop position (guide position) A3 to wait (See FIGS. 10 and 16A)(S18) by rotating the boss 119 of FIG. 8B back by 150° (distancing from the upper face of the sheet). Further, if the number of the sheet is more than 70 and less than 100, the pressing operation for the upper face of the tail end of the sheet P is executed using the limiting pressure member 100 by a forward rotation of the boss 119 by 90°.

Thereafter, the boss 119 is rotated back by 90° so that the limiting pressure member 100 returns to the third stop position A3 of FIG. 10. The sheet P is then guided to the rear end fence 19 by the limiting pressure member 100 in the third stop position A3. If the number of the sheet P stacked on the staple tray 21 is 100 or more, (YES is Step 15 of FIG. 10), the controller inhibits the stacking operation (Step S19) and the program returns.

Further, distances of these stop positions A1, A2, and A3 in FIGS. 16A from the sheet stacking face 21*a* in FIG. 7 are determined as follows:

$$A1<A2<A3,$$

and the pressing position is also determined as follows:

$$R1<R2<R3.$$

Figure 14:
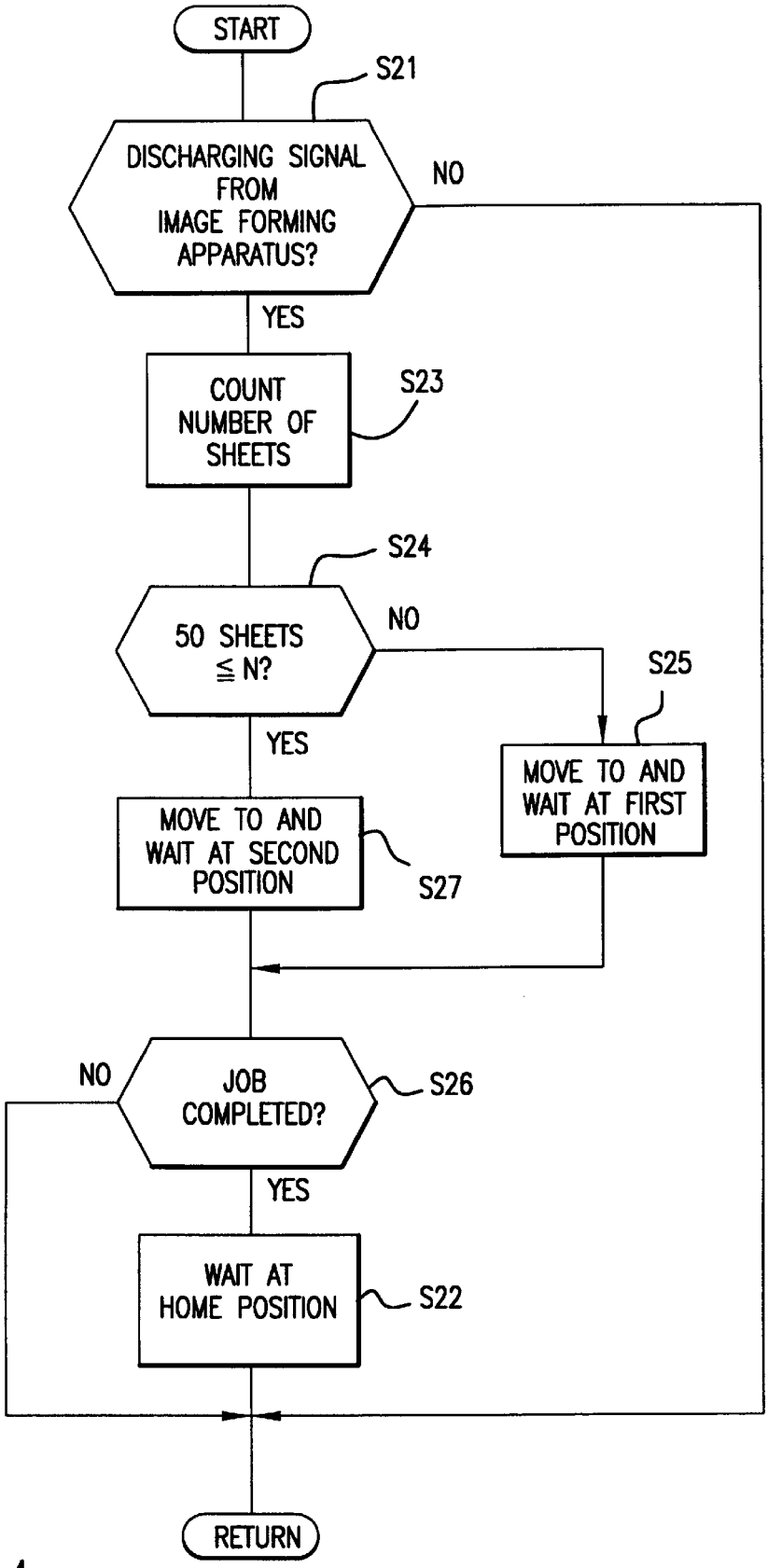
FIG. 14 is a flowchart showing a second control operation.

Next, the second control operation of the first embodiment will be explained referring to the flowchart in FIG. 14 and to FIG. 16B. In the second control operation, the limiting pressure member 100 is used only for limiting the sheet conveying path. In other words, the limiting pressure member 100 (the name is changed to a limiting guide member 100) functions only as a guiding member for the sheet. FIG. 14 is a flowchart showing a second control operation of the limiting guide member 100. This control operation controls the stop position of the limiting guide member 100 in two steps so that suitable value of the stop position for the number of the stacked sheets can be obtained.

The controller first judges whether the sheet discharging signal from the main body of the image forming apparatus exists (Step S21). If the discharging signal does not exist (NO in Step S21), the program returns. If the sheet discharging signal exists (Yes, in Step S21), since the sheet is conveyed into the sheet processing apparatus, a counter counts the number of the sheet according to the passing signal from the sheet discharging sensor (Step S23), then the controller judges whether the number of the sheets is 50 or more (Step S24). If the number of the sheet is less than 50 (NO in Step S24), the limiting guide member 100 (jogger fence 9, or rear end fence 19 in FIG. 10) is moved to/waits at the first stop position A1 from the home position (Step S25) (See FIG. 16B), and if the job is not completed (NO in Step S26), the program returns, and if the job is completed (YES in Step S26), the limiting guide member 100 is moved to the home position HP in FIG. 16C and the program returns.

Further, if the number of the sheet is 50 or more (YES in Step S24), the limiting guide member 100 (jogger fence 9, or rear end fence 19 in FIG. 10) is moved to/waits at the second stop position A2 which is more distant from the sheet stacking face 21*a* of FIG. 7 than the first stop position A1 in FIG. 16B (Step S27). If the job is not completed (NO in Step S26), the program returns, and if the job is completed (YES in Step S26), the limiting guide member 100 in FIG. 16C is moved to the home position HP (Step S22) and returns. Therefore, the sheet can be guided with the limiting guide member 100 positioned corresponding to the number of the stacked sheets. Further, the number of the stacked sheets is not limited to 50. Further, the number of steps for controlling the stop position of the limiting guide member 100 may be three steps as in the first control operation, or more steps may be used.

Figure 15:
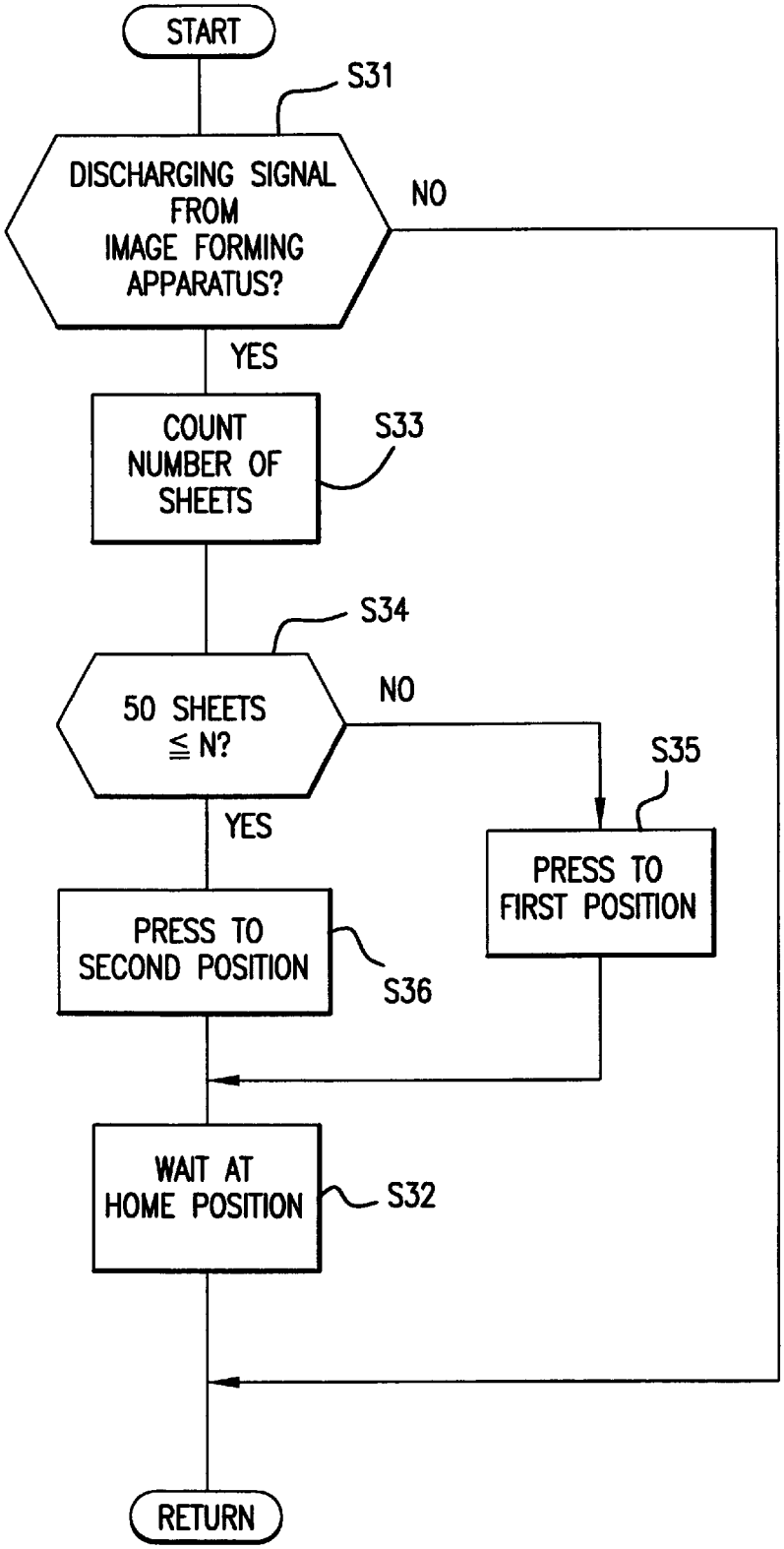
FIG. 15 is a flowchart showing a third control operation.

Next, a third control operation of the first embodiment will be explained referring to the flowchart in FIG. 15, and to FIG. 16C. In the third control operation, the limiting pressure member 100 in the first control operation is used only for pressing the sheet P that is stacked on the staple tray 21 in FIG. 10. In other words, the limiting pressure member 100 (the name is changed to a pressing member) functions only as a pressing member for the sheets P. FIG. 15 is a flowchart showing the third control operation of the pressing member. This example controls the pressing operation for the bundle of sheets by changing the pressing position (the distance between the pressing member and the sheet stacking face of the staple tray 21) of the pressing member 100 in two steps. In the pressing member 100, a spring back mechanism is mounted as shown in FIG. 12B, and the pressing position is changed corresponding to the number of the stacked sheets so that a variation of the pressure is decreased.

The controller judges whether the sheet discharging signal from the main body of the image forming apparatus exists (Step S31 in FIG. 15). If the sheet discharging signal does not exist (NO in Step S31) the program returns. If the sheet discharging signal exists (YES in Step S31), since the sheet is conveyed into the sheet processing apparatus, the number of the sheet P is counted by the counter with the passing signal from the sheet discharging sensor (Step S33). Then the controller judges whether the number of the sheet is 50 or more (Step S34). If the number is 50 or less (NO in Step S34), the pressing member 100 (the jogger fence 9 and the rear end fence 19 in FIG. 10) is moved to the first pressing position R1 (See FIG. 16C) from the home position HP and pressed to the bundle of sheets (Step S35). Thereafter, the pressing member 100 is retreated to the home position HP to wait (Step S32), and then returns. Accordingly, this operation (the Steps S31 to S35 in FIG. 15) is repeated for the number of the sheets which is less than 50.

If the number is more than 50 (NO in Step S34), the pressing member 100 (the jogger fence 9 and the rear end fence 19 in FIG. 10) is moved to the second pressing position R2 from the home position HP (See FIG. 16C), and presses the bundle of sheets (Step S36). Then, the pressing member 100 is retreated to the home position (Step S32). This operation is repeated. Further, the number is not limited to 50. Furthermore, the number of the steps may be three steps as in the first control operation, or more than three steps may be determined. Furthermore, in the first embodiment, the limiting pressure member 100 limits (guides) and presses the sheets at the central part. However, a modified embodiment of the first embodiment as indicated by a dot and a dot-and-dash line in FIG. 7, and as shown in FIGS. 12A and 12B is also possible.

Figure 8A:
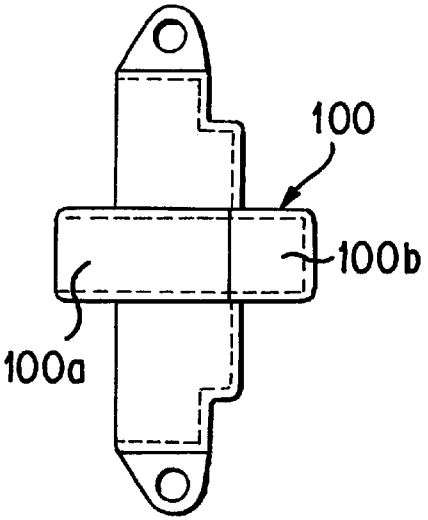
FIG. 8A is an explanatory view from a sheet pressing face side in the first embodiment.
Figures 12A, 12B:
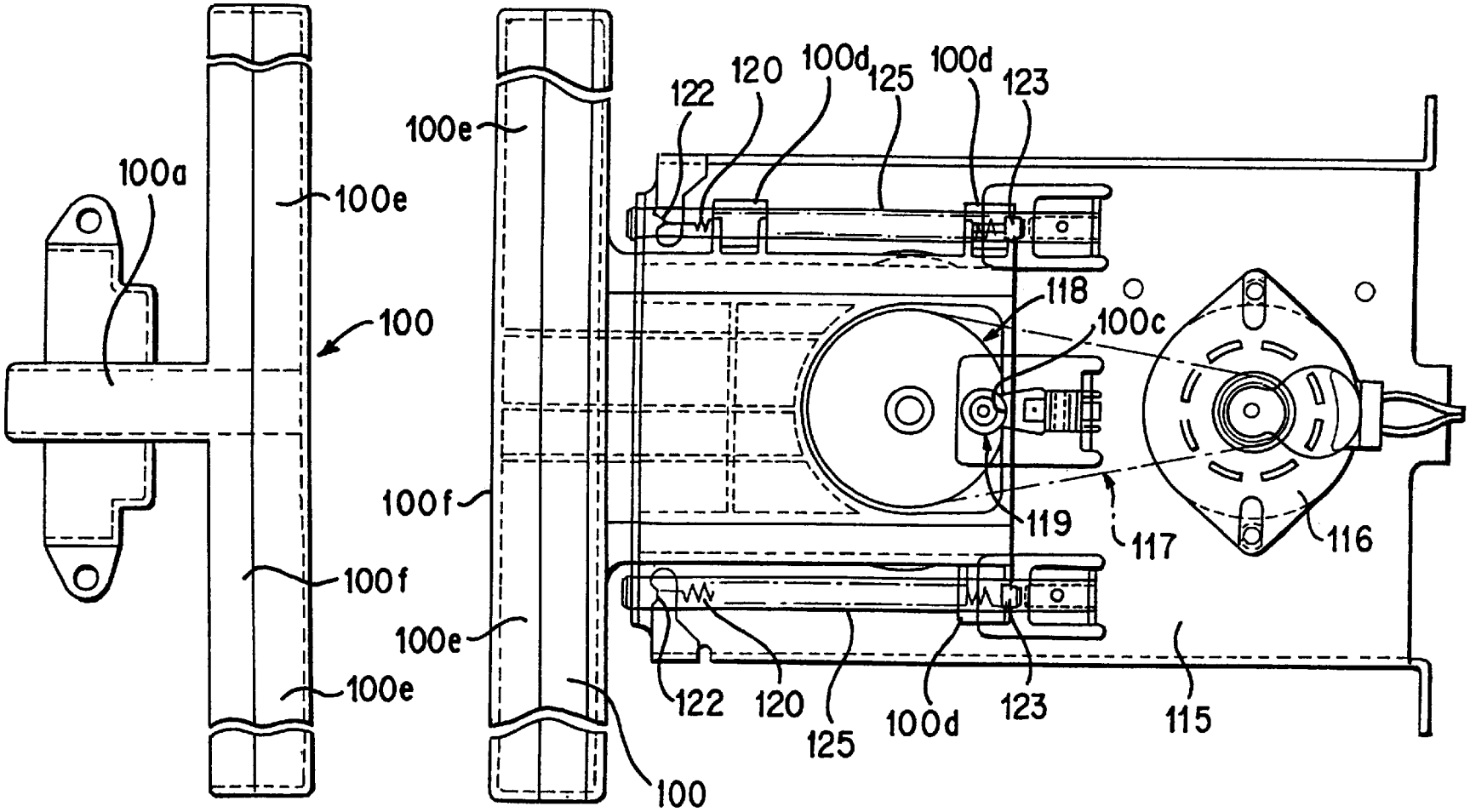
FIG. 12A is an elevation looking from the pressing face in the first embodiment.
FIG. 12B is a top plan view showing the first embodiment.

In this modified embodiment, an upper part of the sheet limiting pressure face 100*a* is vertically extended to exceed the height of the fixed pieces 19*a* and 19*b* as shown in FIG. 4, and further extended perpendicular to the vertical direction and approximately parallel to the sheet stacking face in an approximately T shaped configuration as shown in FIG. 12A. An inclining sheet guide face 100*e* is similar to the inclining sheet guide face 100*b* in FIGS. 8A and 8B, and an upper sheet limiting pressure face 100*f* in FIGS. 12A and 12B is similar to the sheet limiting pressure face 100*a*. This modified embodiment is indicated by a dot-and-dash line in FIG. 7 for distinguishing it from the first embodiment. In such a modified embodiment, the areas of the sheet guide part, the sheet limiting part and the sheet pressing part are made in a large size, and accordingly the sheet is more accurately stacked and aligned.

Figure 17:
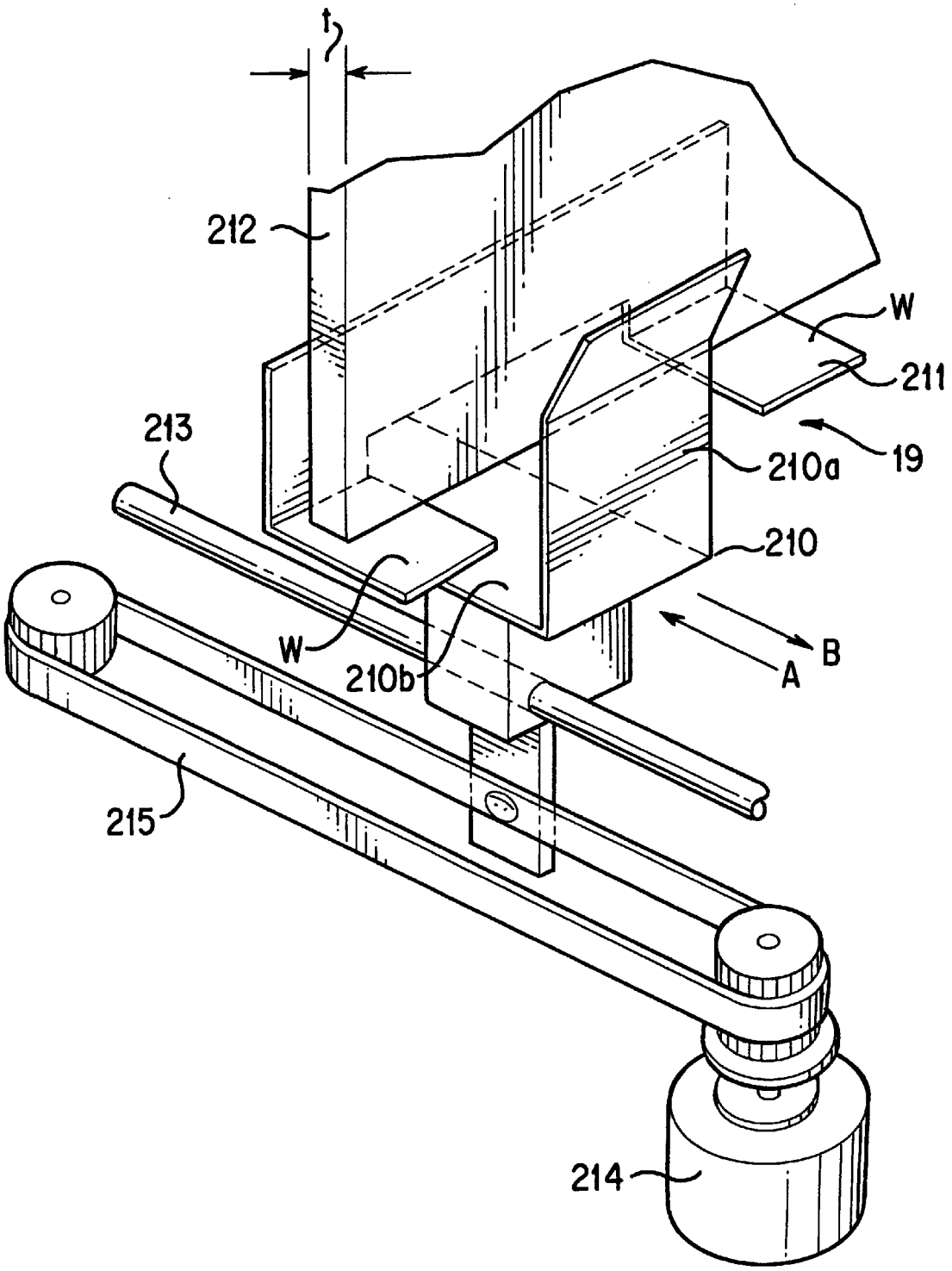
FIG. 17 is an explanatory view showing a second embodiment of the present invention.

FIG. 17 illustrates a second embodiment of the present invention. In this embodiment, the limiting member that limits (presses) the bundle of sheets to the sheet stacking face 21*a* is the rear end fence 19 that is moveable in a direction of a thickness of the sheet (the direction indicated by arrows A and B in FIG. 17). Namely, the rear end fence 19 is composed of a fixed base fence 211 that has a base face W for vertically aligning the sheets striking there against and a movable rear end fence 210. The central part of the base fence 211 is cut out and the rear end fence 210 is disposed at the cut out part. The rear end fence part 210 is moveable in the direction of the thickness of the sheet (indicated by arrows A and B in FIG. 17 as described above). The moveable rear end fence part 210 has a first facing face 210*a* that faces the sheet stacking face 21*a* of the staple tray 21 in FIG. 7 and a base part 210*b* in FIG. 17 that is formed by bending the bottom end of the first facing face 210*a* towards the staple tray. The moveable rear end fence 210 is guided by a guide rod 213 beneath the base part 210*b* and is moved in directions A and B by a timing belt 215 that is driven by a motor 214. An upper face of the base part 210*b* of the moveable rear end fence 210 is disposed lower than the base face W of the base fence 211, so that the moveable rear end fence part 210 can smoothly move without touching the tail end of the sheet P.

Further, the thickness t of the bundle of sheets stacked on the base fence 211 varies depending on a number of the sheets. However, when the bundle of sheets 212 includes a small number of sheets, the movable rear end fence 210 is moved in the direction A by the timing belt 215 driven by the motor 214, and is guided by the guide rod 213.

Since the first facing face 210*a* that contacts an upper face of the bundle of sheets 212 is formed on the movable rear end fence 210, the movable rear end fence 210 can press the bundle of sheets 212 in the direction of thickness of the the sheet by the first facing face 210*a* and push the same towards the sheet stacking face 21*a* (see FIG. 4) of the staple tray 21 when the movable rear end fence 210 moves in the direction A.

When the number of the sheets in the bundle of sheets 212 counted by a counter that counts the number of the sheets detected by the sheet discharging sensor 37 increases, the motor 214 rotates in a contrary direction so that the movable rear end fence 210 moves in the direction B. The movable rear end fence 210 may move stepwise corresponding to the thickness t of the bundle of sheets 212, or may be driven in a manner repeating the motion of pressing-to and retreating-from the bundle of sheets by the first facing face 210*a,* sheet by sheet, or several sheets by several sheets, or a combination of the above. Further, in the second embodiment (even though the detailed explanation is omitted), the movable rear end fence 210 can function as a limiting pressure member (guiding pressure member) that operates both for limiting and pressing the sheets, a limiting member (guide member) that operates only to limit the sheet, or a pressing member that operates only to press the sheets, in the same manner as in the first embodiment by operating according to the control shown in FIGS. 13 through 16.

Figure 18:
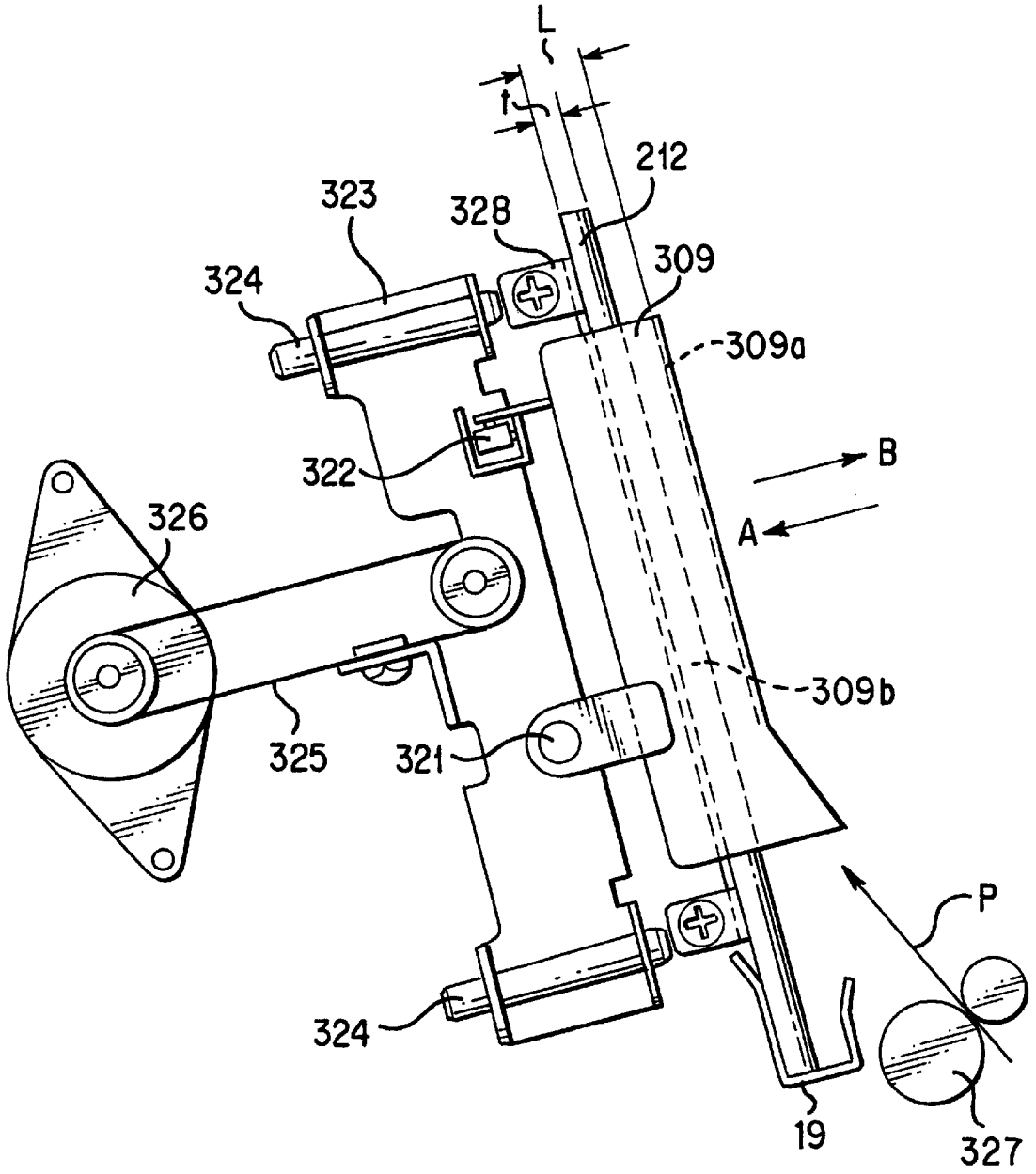
FIG. 18 is an explanatory view showing a third embodiment of the present invention.

Next, a third embodiment of the present invention is explained with reference to FIG. 18. In the third embodiment, a pair of jogger fences 309 that move in the thickn ess direction (the direction indicated by arrows A or B in FIG. 18) function as the limiting member that guides the conveyed sheets to receive the same, or that limit the sheets P stacked on the staple tray in the thickness direction. The pair of jogger fences 309 face the sheet stacking face of the staple tray and are provided with a second facing face 309*a* that faces the uppermost face of the stacked sheet, as shown in FIG. 18. A contacting face 309*b* contacts the side portion of the sheets P. The pair of jogger fences 309 reciprocates in the depth direction (perpendicular to the sheet face of FIG. 18) while guided by a first guide rod 321 and a guide roller 322, and aligns the bundle of sheets 212 in a lateral direction (perpendicular to the sheet conveying direction).

The pair of jogger fences 309 is movable toward or away from the staple tray by a jogger fence drive unit (not shown) that reciprocates the pair of jogger fences 309 in the thickness direction of the bundle of sheets 212. The jogger fence drive unit includes the slider 323, a first guide rod 321, the guide roller 322, a second guide rod 324, a timing belt 325 and a motor 326. The pair of jogger fences 309 is mounted on the slider 323 via the first guide rod 321 and the guide roller 322. Namely, the pair of jogger fences 309 is moved in the direction indicated by the arrows A or B along with the movement of the slider 323.

The slider 323 is movably supported in a direction indicated by the arrow A or B by being guided by the second guide rod 324. Further, the slider 323 is connected to the timing belt 325. Accordingly, the slider 323 is moved in the direction of arrow A or B by the motor 326 via the timing belt 325.

The sheet P is conveyed into the pair of jogger fences 309 by a sheet discharging roller 327. When the number of the sheet P is small, a difference between the distance L between the staple tray and the second facing face 309*a* of the pair of jogger fences 309, and the thickness t of the bundle of sheet 212 is large. Accordingly, if the sheet P curled, the sheet P cannot be smoothly inserted between the staple tray and the second facing face 309*a* of the pair of jogger fences 309, and cannot properly be stacked on the staple tray. Accordingly, the pair of jogger fences 309 is moved to change the distance L corresponding to the thickness of the bundle of sheet 212 by moving the slider 323. When the thickness t of the bundle of sheets 212 is small, the pair of jogger fences 309 is moved in the direction of arrow A, and when the thickness t of the bundle of sheets 212 is large, the pair of jogger fences 309 is moved in the direction of arrow B.

Further, in the third embodiment (the detailed explanation of the control operation is omitted), the pair of jogger fences 309 also functions as a limiting member that operates only for limitation of the sheet, the same as in the first embodiment, executing the control operation in FIG. 14 by the second facing face 309*a* of the pair of jogger fences 309, the same as with the limiting pressure member in the first embodiment.

Furthermore, for changing the limiting position and the pressing position of the limiting pressure member in the first embodiment, and the movable rear end fence part in the second embodiment, and the limiting position of the second facing face 309*a* of the pair of jogger fences 309 in the third embodiment, corresponding to the thickness (number) of the sheet P stacked on the staple tray, the number of the sheets P stacked on the staple tray is counted in accordance with the sheet discharging signal from the image forming apparatus.

Figure 19:
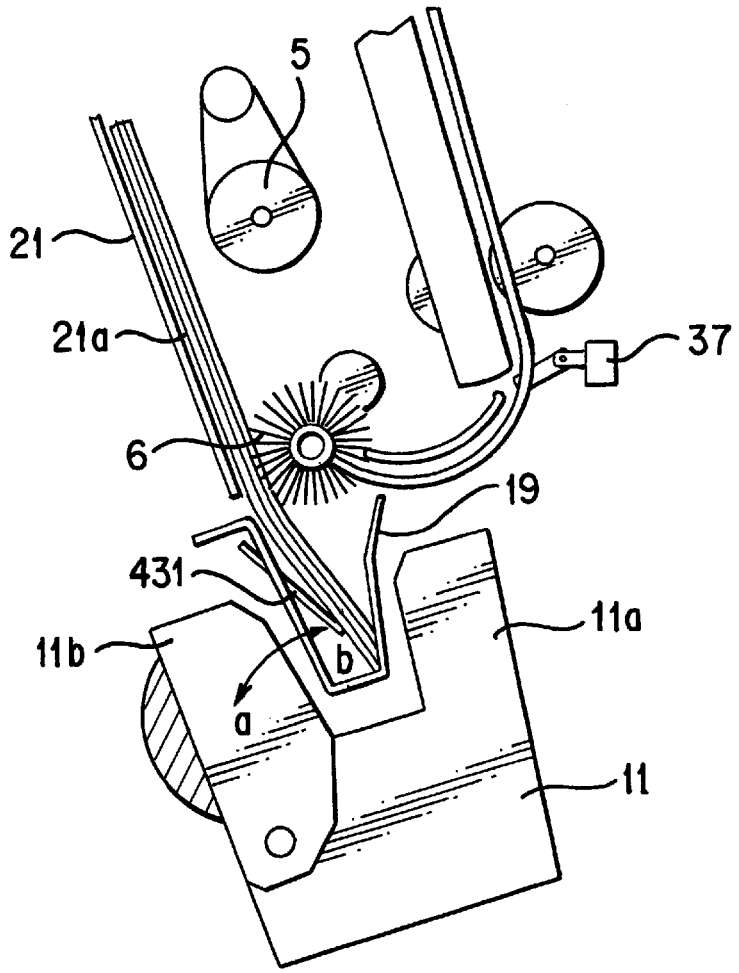
FIG. 19 is an explanatory view showing a fourth embodiment of the present invention.
Figure 20:
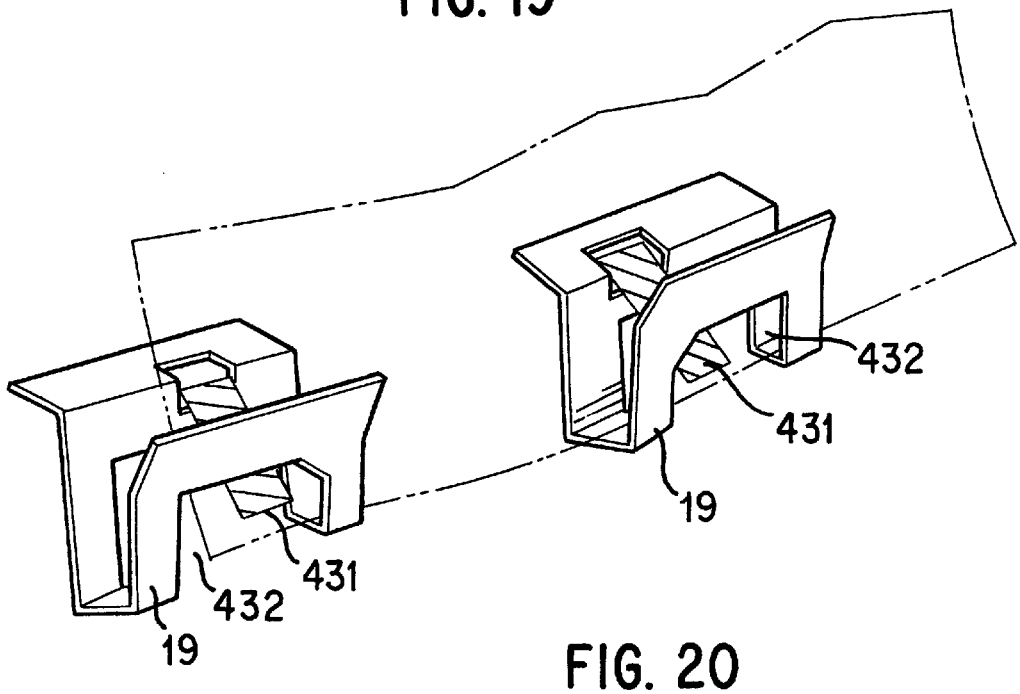
FIG. 20 is a perspective view showing the fourth embodiment of the present invention.
Figure 21:
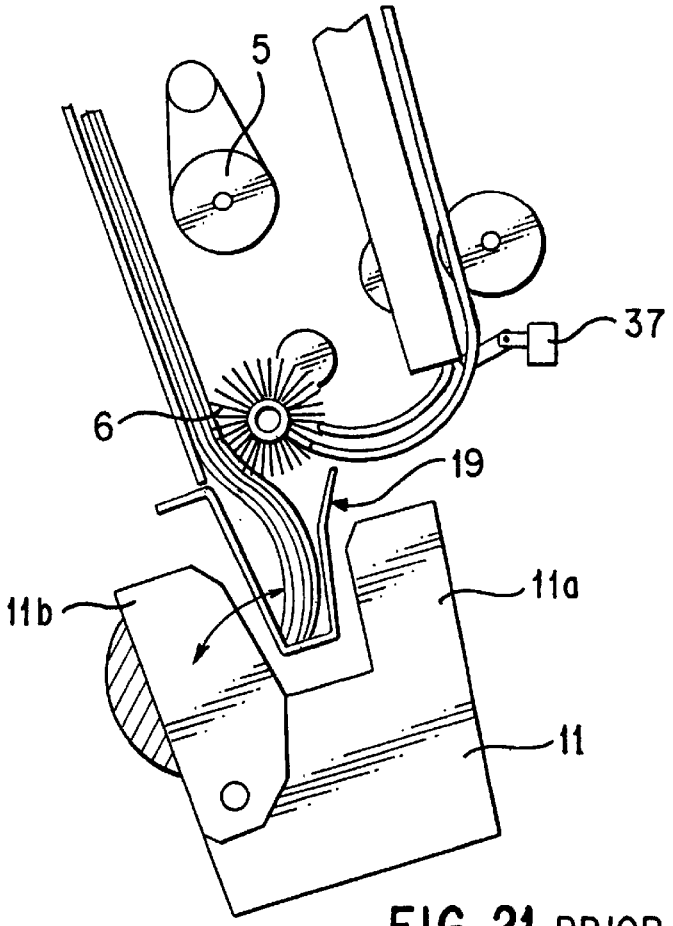
FIG. 21 PRIOR ART
FIG. 21 is an illustration showing a sheet bending down in the rear end fence.
Figure 22:
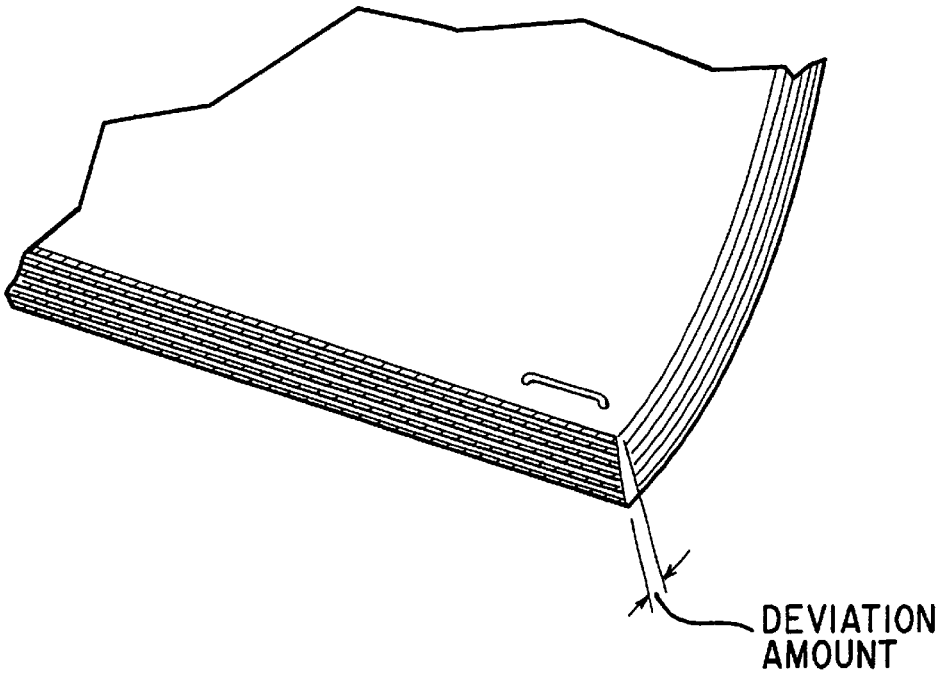
FIG. 22 PRIOR ART
FIG. 22 is a perspective view of a bundle of sheets stapled with a deviated tail end portion.

Next, a fourth embodiment of the present invention is explained. As shown in FIGS. 19 and 20, an elastic guiding pressure member 431 that pushes the end part of the bundle of sheets towards the fixed part 11*a* of the staple unit 11 is mounted at the rear end fence 19. In addition, a cut out part 432 is formed in FIG. 20 at the rear end fence 19 from the bottom, and the guiding pressure member 431 is disposed close to one side of the cut out part 432 so that the movable part 11*b* of the staple unit 11 in FIG. 19 passes through a part close to another part of the cut out part 432 in FIG. 20 when the staple unit operates. Due to the guiding pressure member 431, the bundle of sheets in FIG. 19 is pressed in the direction of the fixed part 11*a* of the staple unit 11. Accordingly, when the movable part 11*b* of the staple unit 11 staples the bundle of sheets by rotating in a direction indicated by an arrow b, the bundle of sheets is prevented from being moved, and therefore the staple operation is accurately executed with no deviation at the bundle of sheets.

In addition, while the movable part 11*b* of the staple unit 11 is described as being at the left side as shown in FIG. 19, it may instead by placed at the right, and the fixed part 11*a* thereof placed at the left. In this case, the guiding pressure member 431 of FIG. 20 is disposed in FIG. 19 at the facing face side of the sheet stacking face 21*a* of the staple tray 21 of the rear end fence 19.

In the first embodiment that executes the second control operation, the sheet processing apparatus is provided with the staple tray that receives and stacks the sheet discharged from the copying machine, the rear end fence that vertically aligns the sheets at the staple tray, and the staple unit that executes a staple operation at an end portion of the bundle of sheets that is vertically aligned with the rear end fence. In the thus constructed sheet processing apparatus, since the limiting pressure member is capable of moving in the thickness direction of the bundle of sheets stacked on the staple tray, and makes the distance between the limiting pressure member and the sheet stacking face of the staple tray for guiding the sheet to the rear end fence variable, even though the rear end fence is large enough to contain a large number of sheets, the tail end of the sheets can be prevented from curling by limiting the sheets in a thickness direction with the limiting pressure member, and since the sheets surely strike the base face of the rear end fence, they are properly stacked and vertically aligned. Accordingly, since the bundle of sheets can be stacked constantly along the base face for both a small number of the sheets and a large number of the sheets with good vertical alignment, a high reliability of a staple operation is obtained.

Other embodiments (detailed explanation is omitted) also have advantages for providing improvement in the stacking efficiency of the sheets, vertical alignment of the sheets, a high reliability of a staple operation or the like. Further, the sheet processing apparatus is applicable to both of a type of sheet processing apparatus in which an image forming apparatus is built in, or a type which is connected to the image forming apparatus.

The controller of this invention may be conveniently implemented using a conventional general purpose digital computer with a microprocessor programmed according to the teachings of the present specification, as is apparent to those skilled in computer technology. Appropriate software coding can readily be prepared by skilled programmers based on the teachings of the present disclosure, as will be apparent to those skilled in the software art. The invention may also be implemented by the preparation of application specific integrated circuits or by interconnecting an appropriate network of conventional component circuits, as will be readily apparent to those skilled in the art.

Obviously, numerous modifications and variations of the present invention are possible in light of the, above teachings. It is therefore to be understood that within the scope of the appended claims, the invention may be practiced otherwise than as specifically described herein.

Having now fully described the invention, it will be apparent to one of ordinary skill in the art that many changes and modifications can be made thereto without departing from the spirit and scope of the invention as set forth herein.

This application is based on Japanese Patent Application No. JPAP-09-152324, filed on Jun. 10, 1997, and No. JPAP-09-234359, filed on Aug. 29, 1997, the entire contents of which are herein incorporated by reference.

What is claimed as new and desired to be secured by Letters Patent of the United States is:

1. A sheet processing apparatus comprising a staple tray having a sheet stacking face on which a sheet discharged from an image forming apparatus may be stacked;

a rear end fence positioned to receive and vertically align a tail end of a sheet stacked on said staple tray;

a pair of jogger fences that laterally align a sheet on said staple tray by contacting a side of the sheet perpendicular to a conveying direction of the sheet;

a stapling device positioned to staple the vertically aligned tail ends of a bundle of at least two of the sheets stacked on said staple tray;

a limiting member that is movable in a direction of a thickness of the bundle of sheets stacked on said staple tray; and a controller which controls a position of said limiting member relative to the sheet stacking face of said staple tray such that the limiting member can assume at least two predetermined positions relative to the sheet stacking face.

2. The sheet processing apparatus according to claim 1, wherein said pair of jogger fences further comprise:

second facing faces which contact the sides of the sheet; and third facing faces that face the sheet stacking face of said staple tray, wherein said third facing face is movable in the direction of thickness of the bundle of sheets stacked on said staple tray and includes said limiting member.

3. The sheet processing apparatus according to claim 1, wherein said controller controls said limiting member such that a distance between said limiting member and said staple tray is variable and corresponds to the thickness of the bundle of sheets stacked on said staple tray.

4. The sheet processing apparatus according to claim 1, wherein said limiting member is disposed between a sheet discharging device that discharges the sheet onto said staple tray and said rear end fence, wherein said limiting member is provided with an inclined sheet guide face inclined such that said inclined sheet guide face guides the tail end of the sheet that is discharged onto said staple tray.

5. The sheet processing apparatus according to claim 1, wherein said limiting member is formed so as to cover approximately an entire width of the sheet stacked on said staple tray, perpendicular to a conveying direction of the sheet stacked on said staple tray.

6. The sheet processing apparatus according to claim 1, further comprising the image forming apparatus, wherein said image forming apparatus is built in said sheet processing apparatus.

7. The sheet processing apparatus according to claim 1, further comprising the image forming apparatus, wherein said image forming apparatus is disposed outside of said sheet processing apparatus.

8. A sheet processing apparatus comprising:

a staple tray having a sheet stacking face on which a sheet discharged from an image forming apparatus may be stacked;

a rear end fence positioned to receive and vertically align a tail end of a sheet stacked on said staple tray;

a pair of jogger fences that laterally align a sheet on said staple tray by contacting a side of the sheet perpendicular to a conveying direction of the sheet;

a stapling device positioned to staple the vertically aligned tail ends of a bundle of at least two of the sheets stacked on said staple tray;

a pressure member that is movable in a direction of a thickness of the bundle of sheets stacked on said staple tray; and a controller controlling said pressure member to press an upper face of the sheet adjacent to said rear end fence every time that a predetermined number of the sheets is discharged onto said staple tray.

9. The sheet processing apparatus according to claim 8, wherein said controller controls said pressure member such that a pressing amount of said pressure member is variable and corresponds to the thickness of the bundle of sheets stacked on said staple tray.

10. The sheet processing apparatus according to claim 9, wherein the thickness of the bundle of sheets is proportional to the number of the sheets stacked on said staple tray.

11. A sheet processing apparatus comprising:

a staple tray having a sheet stacking face on which a sheet discharged from an image forming apparatus may be stacked;

a rear end fence positioned to receive and vertically align a tail end of a sheet stacked on said staple tray;

a pair of jogger fences that laterally align a sheet on said staple tray by contacting a side of the sheet perpendicular to a conveying direction of the sheet;

a stapling device positioned to staple the vertically aligned tail ends of a bundle of at least two of the sheets stacked on said staple tray;

a limiting pressure member that is movable in a direction of a thickness of the bundle of sheets stacked on said staple tray; and a controller controlling said limiting pressure member to press an upper face of the sheet adjacent to said rear end fence every time that a predetermined number of the sheets is discharged onto said staple tray.

12. The sheet processing apparatus according to claim 11, wherein said controller controls said limiting pressure member such that a pressing amount of said limiting pressure member is variable and corresponds to the thickness of the bundle of sheets stacked on said staple tray.

13. The sheet processing apparatus according to claim 11, wherein said controller controls said limiting pressure member such that a distance between said limiting pressure member an d said staple tray is variable and corresponds to the thickness of the bundle of sheets stacked on said staple tray.

14. The sheet processing apparatus according to claim 11, wherein said limiting pressure member is disposed between a sheet discharging device that discharges the sheet onto said staple tray and said rear end fence, wherein said limiting pressure member is provided with an inclined sheet guide face inclined such that said inclined sheet guide face guides the tail end of the sheet that is discharged onto said staple tray.

15. The sheet processing apparatus according to claim 11, wherein said limiting pressure member is formed so as to cover approximately an entire width of the sheet stacked on said staple tray, perpendicular to a conveying direction of the sheet stacked on said staple tray.

16. A sheet processing apparatus comprising:

a staple tray having a sheet stacking face on which a sheet discharged from an image forming apparatus may be stacked;

a rear end fence positioned to receive and vertically align a tail end of a sheet stacked on said staple tray;

a stapling device positioned to staple the vertically aligned tail ends of a bundle of at least two of the sheets stacked on said staple tray;

a limiting member that is movable in a direction of a thickness of the bundle of sheets stacked on said staple tray; and a controller which controls a position of said limiting member relative to the sheet stacking face of said staple tray such that the limiting member can assume at least two predetermined positions relative to the sheet stacking face;

wherein said rear end fence includes a hitting face against which a sheet discharged onto the staple tray strikes, and a first facing face that faces the sheet stacking face of said staple tray and is movable in a direction of the thickness of the sheets stacked on said staple tray, and wherein said first facing face includes said limiting member.

17. The sheet processing apparatus according to claim 16, wherein said hitting face comprises a plurality of hitting faces and wherein said limiting member is movable so as to be inserted between the plurality of hitting faces.

18. A sheet processing apparatus comprising:

a staple tray having a sheet stacking face on which a sheet discharged from an image forming apparatus may be stacked;

a rear end fence positioned to receive and vertically align a tail end of a sheet stacked on said staple tray;

a stapling device positioned to staple the vertically aligned tail ends of a bundle of at least two of the sheets stacked on said staple tray;

a pressure member that is movable in a direction of a thickness of the bundle of sheets stacked on said staple tray; and a controller controlling said pressure member to press an upper face of the sheet adjacent to said rear end fence every time that a predetermined number of the sheets is discharged onto said staple tray;

wherein said rear end fence includes a hitting face against which a sheet discharged onto the staple tray strikes, and a first facing face that faces the sheet stacking face of said staple tray and is movable in a direction of the thickness of the sheets stacked on said staple tray, and wherein said first facing face includes said pressure member.

19. A sheet processing apparatus comprising:

a staple tray having a sheet stacking face on which a sheet discharged from an image forming apparatus may be stacked;

a rear end fence positioned to receive and vertically align a tail end of a sheet stacked on said staple tray;

a stapling device positioned to staple the vertically aligned tail ends of a bundle of at least two of the sheets stacked on said staple tray;

a limiting pressure member that is movable in a direction of a thickness of the bundle of sheets stacked on said staple tray; and a controller controlling said limiting pressure member to press an upper face of the sheet adjacent to said rear end fence every time that a predetermined number of the sheets is discharged onto said staple tray;

wherein said rear end fence includes a hitting face against which a sheet discharged onto the staple tray strikes, and a first facing face that faces the sheet stacking face of said staple tray and is movable in a direction of the thickness of the sheets stacked on said staple tray, and wherein said first facing face includes said limiting pressure member.

20. The sheet processing apparatus according to claim 19, wherein said hitting face comprises a plurality of hitting faces and wherein said limiting pressure member is movable so as to be inserted between the plurality of hitting faces.

21. A sheet processing apparatus comprising:

a staple tray having a sheet stacking face on which a sheet discharged from an image forming apparatus may be stacked;

a rear end fence positioned to receive and vertically align a tail end of a sheet stacked on said staple tray, wherein said rear end fence includes a hitting face against which the sheet strikes, and a first facing face that faces the sheet stacking face of said staple tray;

a pair of jogger fences that laterally align a sheet on said staple tray by contacting a side of the sheet perpendicular to a conveying direction of the sheet;

a stapling device positioned to staple the vertically aligned tail ends of a bundle of at least two of the sheets stacked on said staple tray; and an elastic sheet guide member disposed so as to incline to press a portion of the tail end of the sheet toward one of said sheet stacking face of said staple tray and said first facing face.

22. The sheet processing apparatus according to claim 21, wherein said stapling device comprises a fixed part and a movable part mounted so as to be movable toward said fixed part to staple a bundle of sheets positioned between said fixed part and said movable part.

23. A method for processing sheets, comprising the steps of:

receiving sheets discharged from an image forming apparatus;

guiding the sheets to a rear end fence of a staple tray;

stacking the sheets on the staple tray;

aligning the sheets laterally on the staple tray by contacting a side of the sheet perpendicular to a conveying direction of the sheet;

aligning the sheets vertically by striking a tail end of the sheet against said rear end fence;

pressing the tail ends of the sheets in a direction of thickness of the sheets; and stapling a bundle of the sheets at the tail ends of the sheets aligned by said rear end fence.

* * * * *